US005928048A

United States Patent [19]

Hattori

[11] Patent Number: 5,928,048

[45] Date of Patent: Jul. 27, 1999

[54] MANUFACTURE OF FIELD EMISSION ELEMENT WITH SHARP EMITTER TIP

[75] Inventor: Atsuo Hattori, Hamamatsu, Japan

[73] Assignee: Yamaha Corporation, Japan

[21] Appl. No.: 08/958,636

[22] Filed: Oct. 27, 1997

[30] Foreign Application Priority Data

Oct. 29, 1996 [JP] Japan ..... 8-287098

[51] Int. Cl.[6] ..... H01J 9/02

[52] U.S. Cl. ..... 445/50

[58] Field of Search ..... 445/24, 50

[56] References Cited

U.S. PATENT DOCUMENTS

| | | | |
|---|---|---|---|
| 5,141,459 | 8/1992 | Zimmerman | 445/24 |
| 5,203,731 | 4/1993 | Zimmerman | 445/24 |
| 5,334,908 | 8/1994 | Zimmerman | 313/336 |
| 5,529,524 | 6/1996 | Jones | 445/24 |
| 5,534,743 | 7/1996 | Jones et al. | 313/309 |
| 5,548,181 | 8/1996 | Jones | 313/309 |
| 5,561,339 | 10/1996 | Jones et al. | 313/309 |
| 5,587,623 | 12/1996 | Jones | 313/497 |
| 5,720,642 | 2/1998 | Hattori | 445/50 |
| 5,795,208 | 8/1998 | Hattori | 445/50 |

*Primary Examiner*—Kenneth J. Ramsey
*Attorney, Agent, or Firm*—Ostrolenk, Faber, Gerb & Soffen, LLP

[57] ABSTRACT

A method of manufacturing a field emission element including the steps of: forming an opening in a partial region of a first film formed on an underlying substrate and thereafter forming a first sacrificial film; etching back the first sacrificial film to expose the surface of the first film and leave a side spacer on the side wall of the opening, the side spacer being made of the first sacrificial film, and continuing to etch back the first sacrificial film to form a recess in the underlying substrate; depositing a second sacrificial film on the recess, the side spacer and the first film to a thickness larger than the radius of curvature of a rounded corner at the bottom of the recess, to form a cusp on the surface of the second sacrificial film, the cusp having a sharp apex at a deepest point where side walls of the second sacrificial film as viewed in cross section contact at the first time; and forming a field emission cathode electrode having a sharp apex by depositing a conductive film on the second sacrificial film.

26 Claims, 23 Drawing Sheets

MANUFACTURE OF FIELD EMISSION ELEMENT WITH SHARP EMITTER TIP

This application is based on Japanese patent application No. 8-287098 filed on Oct. 29, 1996, the entire contents of which are incorporated herein by reference.

BACKGROUND OF THE INVENTION a) Field of the Invention

The present invention relates to a method of manufacturing a field emission element, and more particularly to a method of manufacturing a field emission element having an emitter tip with a small radius of curvature and a small apex angle.

b) Description of the Related Art

A field emission element emits electrons from a sharp tip of an emitter by utilizing electric field concentration. For example, a flat panel display can be structured by using a field emitter array (FEA) having a number of emitters disposed on the array. Each emitter controls the luminance of a corresponding pixel of the display.

FIGS. 19A and 19B illustrate conventional manufacture methods of a field emission element.

As shown in FIG. 19A, on a substrate 101 having a recess with a vertical side wall, a sacrificial film 103 is deposited by a deposition method having good step coverage. The upper surface of the sacrificial film 103 has a tapered portion at the recess, which portion broadens its area toward the upper surface. An emitter electrode (cathode) film 105 is formed by using this sacrificial film 103 as a mold (cusp). Thereafter, the substrate 101 and sacrificial film 103 under the emitter electrode film are removed to form an emitter electrode 105 having a sharp tip A. The radius of curvature of the tip A of the emitter electrode 105 depends upon the shape of the recess and the deposition conditions of the sacrificial film. If the radius of curvature is large, an electric field is hard to concentrate and the electrical performance is not good.

As shown in FIG. 19B, if a sacrificial film 103 is deposited thick on a substrate 101 having a recess, two parts in cross section of the sacrificial film 103 at the recess become partially in unison so that an emitter electrode 105 having a relatively small apex angle of the emitter tip can be formed.

With this method, however, it is necessary to deposit the sacrificial film thick so that the tip of the emitter electrode 105 is formed at a higher position remote from the bottom of the recess in the substrate 101. If a field emission element has a gate electrode in addition to an emitter electrode, this gate electrode is generally formed near at the boundary between the substrate 101 and the sacrificial film 103, although not shown in FIG. 1913. With the method illustrated in FIG. 19B, the emitter electrode 105 is formed remotely from the gate electrode so that a high drive voltage of the field emission element is required and the electrical performance is lowered.

As described above, a large radius of curvature of the emitter electrode tip makes an electric field hard to concentrate, lowering the performance of the field emission element. A relative position of the emitter and gate electrodes greatly influences the performance of the field emission element.

SUMMARY OF THE INVENTION

It is an object of the present invention to provide a manufacture method of a field emission element having a field emission cathode (emitter) with a small apex angle and radius of curvature of the emitter tip.

It is another object of the present invention to provide a manufacture method of a field emission element having a field emission cathode, capable of positioning an emitter tip with high precision.

According to one aspect of the present invention, there is provided a method of manufacturing a field emission device, comprising the steps of: a) providing a substrate; b) forming a conductive film over the substrate, the conductive film having a vertical cross section which includes laterally separated regions; c) forming a first sacrificial layer over the conductive film and the substrate; d) removing the first sacrificial layer so as to leave a spacer film on a side wall of the conductive film, the spacer film having a height lower than the conductive film and a part of the substrate being etched to provide a recess having a rounded corner at a bottom of the recess; e) forming a second sacrificial layer over the conductive film, the spacer film and the substrate; and f) forming an electron emitting material layer over the second sacrificial layer.

After the first sacrificial layer is formed over the conductive film and the substrate, it is etched back to form the spacer on the side wall of the conductive film having a vertical cross section which includes laterally separated regions. The spacer film has a height lower than the conductive film and a part of the substrate is etched to provide a recess having a rounded corner at a bottom of the recess. The recess has a diameter smaller by an amount corresponding to the spacer width than the width of the vertical cross section of the conductive film. The second sacrificial layer is formed over the conductive film, spacer film and substrate. Thereafter, the electron emitting material layer is formed over the second sacrificial layer. Since a cusp with a sharp tip is formed on the upper surface of the second sacrificial layer and this cusp is used as a mold for a field emission element, the field emission element having a small apex angle and radius of curvature can be formed.

According to another aspect of the present invention, there is provided a method of manufacturing a field emission element comprising the steps of: (a) forming a first film on an underlying substrate; (b) forming an opening reaching the underlying substrate in a partial region of the first film; (c) forming a first sacrificial film on the opening and on the first film; (e) etching back the first sacrificial film to expose the surface of the first film and leave a side spacer on the side wall of the opening, the side spacer being made of the first sacrificial film, and further etching back the first sacrificial film to form a recess in the underlying substrate; (g) depositing a second sacrificial film on the recess, the side spacer and the first film to a thickness larger than the radius of curvature of a rounded corner of the recess, to form a cusp on the surface of the second sacrificial film, the cusp having a sharp apex at a deepest point where side walls of the second sacrificial film as viewed in cross section contact at the first time; and (h) forming a field emission cathode electrode having a sharp apex by depositing a conductive film on the second sacrificial film and filling the cusp.

After the first sacrificial layer is formed over the first sacrificial film having the opening, the first sacrificial layer is etched back to form the side spacer on the side wall of the opening. As the etch-back is further progresses, the recess is formed in the underlying substrate. The recess has a diameter smaller by an amount corresponding to the spacer width than the width of the opening of the first film. The second sacrificial layer is formed over the conductive film, spacer film and substrate to a thickness larger than the radius of curvature of the rounded corner of the recess, to form a cusp on the surface of the second sacrificial film, the cusp having a sharp apex at a deepest point where side walls of the second sacrificial film as viewed in cross section contact at the first time. Since this cusp is used as a mold for a field emission element, the field emission element having a small apex angle and radius of curvature can be formed.

According to another aspect of the present invention, there is provided a method of manufacturing a field emission element comprising the steps of: (a) forming a first film on an underlying substrate; (b) forming a second film on the first film; (c) forming an opening in a partial region of the second film, the opening reaching the first film; (d) forming a first sacrificial film on the bottom of the opening and on the second film; (e) etching back the first sacrificial film and leaving a side spacer on the side wall of the opening, the side spacer being made of the first sacrificial film; (f) continuing to etch back the first sacrificial film to form a recess in the underlying substrate by forming an opening reaching the underlying substrate in the first film, by using the side spacer and the second film as a mask; (g) depositing a second sacrificial film on the recess, the side spacer and the second film to form a cusp on the surface of the second sacrificial film, the cusp having a sharp apex at a deepest point where side walls of the second sacrificial film as viewed in cross section contact at the first time; and (h) forming a field emission cathode electrode having a sharp apex by depositing a conductive film on the second sacrificial film and filling the cusp.

After the first sacrificial film is formed on the second film having the opening, the first sacrificial film is etched back to form the side spacer on the side wall of the opening. The first sacrificial film is further etched by using the side spacer and second film as a mask to form a through hole in the first film. As the etching further progresses, the recess is formed in the underlying substrate. The second sacrificial film is formed on the recess, side spacer and second film, to form a cusp on the surface of the second sacrificial film, the cusp having a sharp apex at a deepest point where side walls of the second sacrificial film as viewed in cross section contact at the first time. This cusp is used as a mold of a field emission cathode electrode to have a small apex angle and radius of curvature of the tip of the cathode.

DETAILED DESCRIPTION OF THE PREFERRED EMBODIMENTS

FIGS. 1A to 1H are cross sectional diagrams illustrating the manufacture steps of a field emission element according to the first embodiment of the invention. In the following, the manufacture steps of an emitter (cathode) constituting a field emission element will be described.

Figure 1A:
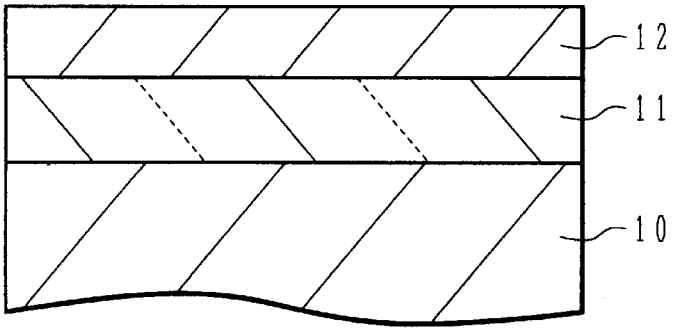
FIGS. 1A to 1H are cross sectional views illustrating the manufacture steps of a field emission element according to a first embodiment of the invention.

As shown in FIG. 1A, a substrate 10 is made of Si, for example. A first insulating film 11 of $SiO_2$ is formed through thermal oxidation on the surface of the substrate 10, to a thickness of about 0.5 $\mu$m. The substrate 10 may be made of Al instead of Si. If the substrate 10 is made of Al, the first insulating film 11 may be made of $Al_2O_3$.

The thermal oxidation may be performed, for example, by using a vertical furnace under the conditions of a furnace temperature of 1000° C., an $H_2$ gas flow of 19 slm and an $O_2$ gas flow of 19 slm.

A first conductive film 12 corresponding to a gate electrode is deposited about 0.3 $\mu$m thick on the surface of the first insulating film 11. The first conductive film 12 may be made of polysilicon doped with P or B which can be deposited through low pressure CVD. For example, the low pressure CVD may be performed by supplying He diluted $SiH_4$ at a flow rate of 0.6slm under the conditions of a temperature of 625° C. and a pressure of 30 Pa. In order to dope B or P, diborane or phosphine is supplied.

Instead of using polysilicon, the first conductive film 12 may be made of amorphous silicon, $WSi_x$, $MoSi_x$, $TaSi_x$, Al, Cu or W. These materials are required to have an etching rate slower than the first insulating film 11, relative to etchants to be described later.

A resist film (not shown) having a predetermined pattern is formed on the first conductive film 12. By using the resist pattern as a mask, the first conductive film 12 is selectively etched to form a hole (gate hole) 12*b* shown in FIG. 1B. The unetched first conductive film 12*a* has two Laterally separated parts as viewed in section. This etching is performed through magnetron reactive ion etching (RIE) with etching gas of $HBr+Cl_2$. The diameter of the hole is about 0.6 $\mu$m.

Figure 1B:
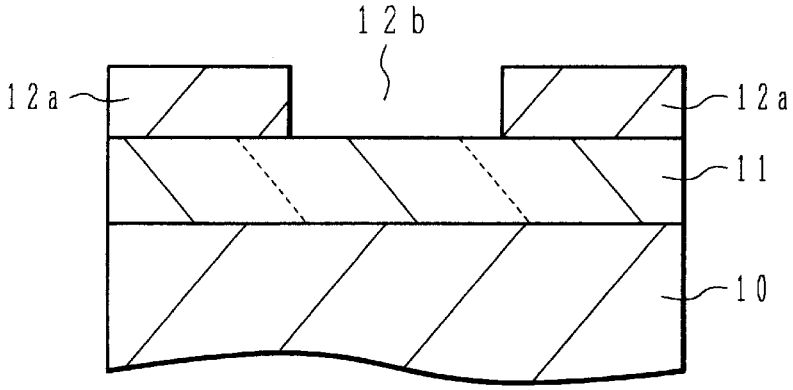
Figure 1C:
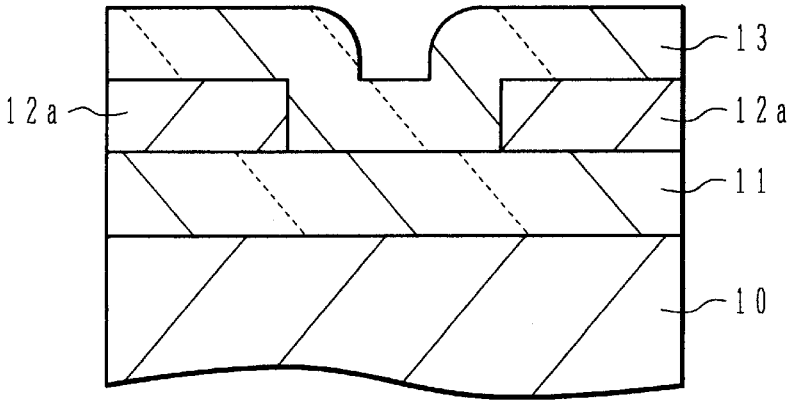

Next, as shown in FIG. 1C, a first sacrificial film 13 made of, for example, $SiO_2$ is deposited on the first conductive film 12*a* and on the exposed first insulating film 11. This first sacrificial film 13 is deposited with a deposition method having good step coverage. For example, atmospheric pressure CVD is performed at a substrate temperature of 400° C. by using source materials of TEOS, $O_3$ and $O_2$. The thickness of the first sacrificial film 13 is about 0.2 μm. An area-reduced recess reflecting topography of the surfaces of the underlaying layers is formed on the surface of the first sacrificial film 13.

Instead of using $SiO_2$, the first sacrificial film 13 may be made of an insulating film of $SiN_x$ or the like or a conductive film made of polysilicon, amorphous silicon, $WSi_x$, $MoSi_x$, $TaSi_x$, Al, Cu or W. The material of the first sacrificial film 13 has preferably an etching rate generally equal to that of the first insulating film 11, relative to etchants to be described later. The materials of the first insulating film 11, first conductive film 12 and first sacrificial film 13 are selected so that at least the etching rates of the first sacrificial film 13 and first insulating film 11 are faster than the first conductive film 12. Preferably, the same material is used for the first sacrificial. and insulating films 13 and 11. In the following, it is assumed that $SiO_2$ is used for the materials of both the first sacrificial and insulating films 13 and 11.

The etching rates of these films satisfy the following relationship. The etching rates of the first sacrificial and insulating films 13 and 11 are generally the same, and that of the first conductive film 12*a* is lower than the etching rates of the first sacrificial and insulating films 13 and 11.

Figure 1D:
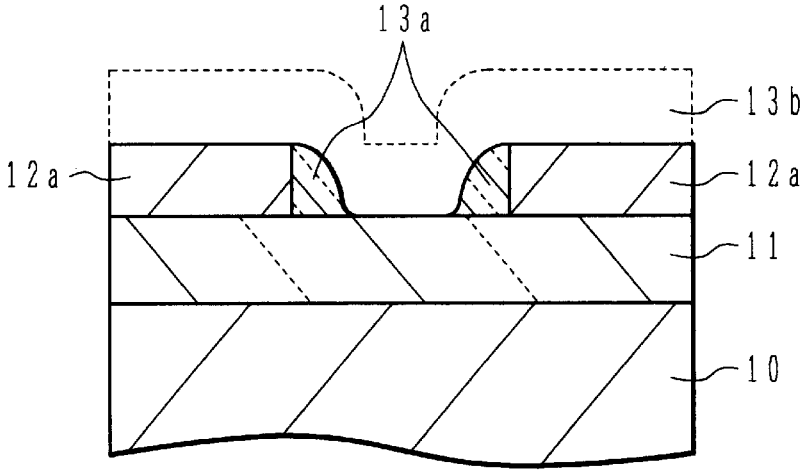

Next, the first sacrificial film 13 of $SiO_2$ is anisotropically etched back through magnetron RIE using a mixed gas of $CHF_3$+$CO_2$+Ar. As shown in FIG. 1D, the region 13*b* of the first sacrificial film 13 on the flat surface is removed, and the region 13*a* on the side wall of the gate hole is Left. Empirically, an inside edge of the gate hole has a tapered shape after the etching. The region 13*a* constitutes a side spacer formed on the side wall of the gate hole in the first conductive film 12*a* made of the two parts (laterally separated regions) as viewed in section.

Figure 1E:
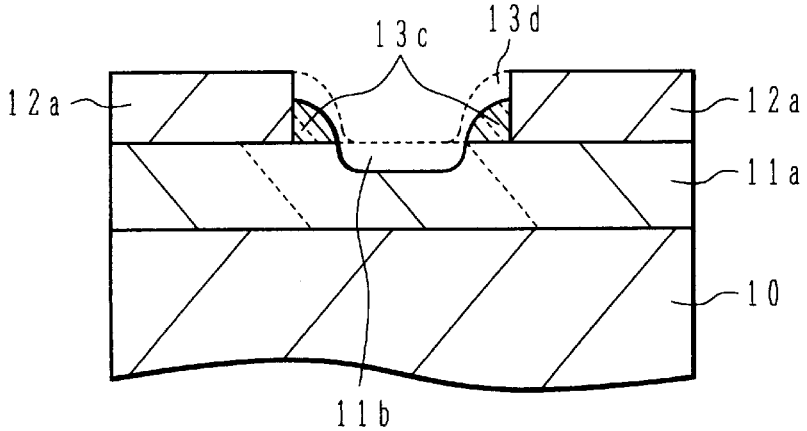

As the etching further progresses, the side spacer 13*a* and first insulating film 11 are etched. As shown in FIG. 1E, the side spacer 13*a* is etched downward from the surface of the first conductive film 12*a* along the direction vertical to the substrate surface, so that the region 13*d* is removed and the region 13*c* is left. The first insulating film 11 is also etched downward along the direction vertical to the substrate surface, by using the first conductive film 12*a* and region 13*c* of the side spacer as a mask, so that the region 11*b* is removed and the region 11*a* is left. The etch-back is stopped when the depth of the recess 11*b* in the first insulating film 11*a* becomes about 0.1 μm. At this time, the bottom of the recess 11*b* has a rounded corner chamfered at a radius r of curvature.

Since the etching rates of the first sacrificial and insulating films 13 and 11 are generally the same, the side spacer 13*d* and the surface region 11*b* of the first insulating film 11*a* are etched by generally the same thickness. The first conductive film 12*a* is hardly etched because its etching rate is considerably slower than those of the first sacrificial and insulating films 13 and 11.

With the etch-back described above, therefore, a side spacer 13*c* is formed on the lower side wall of the recess in the first conductive film 12*a*, with the shape of the first conductive film 12*a* being maintained unchanged. The upper side wall of the first conductive film 12 is therefore exposed and a step is formed at the boundary between the exposed upper side wall and the side spacer 13*c*. This step is used for forming a cusp mold for an emitter electrode having a two-stage shaped structure. An emitter electrode of a two-stage shaped structure has a mechanically strong base so that the tip of the emitter electrode is hard to be broken.

Figure 1F:
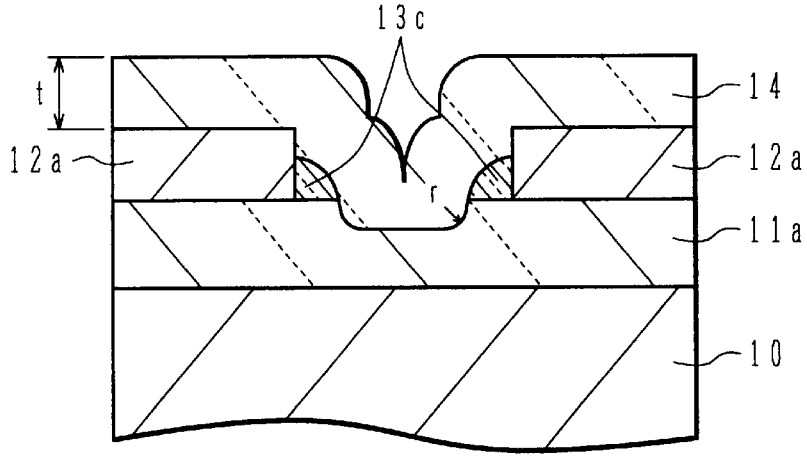

Next, as shown in FIG. 1F, a second insulating film 14 is deposited on the substrate, this film being made of $SiO_2$, for example. The second insulating film 14 is deposited by a deposition method with good step coverage. For example, it may be formed through atmospheric pressure CVD at a substrate temperature of 400° C. by using TEOS, $O_3$ and $O_2$ as source materials. Instead of using $SiO_2$, the second insulating film 14 may be made of $SiN_x$ or SiON.

Since the second insulating film 14 is deposited by a method having good step coverage, it has a surface shape reflecting topography of the underlying surfaces of the first conductive film 12*a*, side spacer 13*c* and first insulating film 11*a*. A valley (cusp) formed on the surface of the second insulating film 14 has a two-stage shaped structure. The first stage structure reflects the corner shape of the recess of the first conductive film 12*a*, and the second stage structure reflects the shape of the side spacer 13*c*.

The thickness t of the second insulating film 14 is set larger than the radius r of curvature of the rounded corner at the bottom of the recess in the surface region 11*b* of the first insulating film 11*a*. The thickness t of the second insulating film 14 is about 0.16 μm. If the thickness t is set larger than the radius r, the tip of the cusp of the second insulating film 14 becomes sharp. As the deposition of the second insulating film 14 progresses, the side walls of the two parts as viewed in cross section couple together. A portion of the cusp at the contact point of the two parts has an acute angle like a contact point between two circles or ellipses. This portion with an acute angle is used as a mold for the two-stage shaped emitter electrode.

Figure 1G:
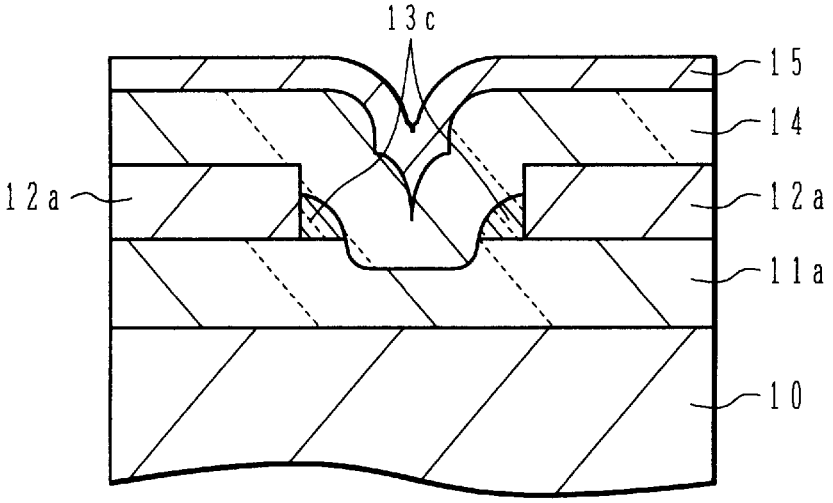

As shown in FIG. 1G, a second conductive film 15 made of, for example, TiN is deposited about 0.05 μm on the second insulating film 14 through reactive sputtering. For example, the reactive sputtering is performed by using a DC sputtering system under the conditions of a power of 5 kW, a pressure of 4 mTorr, a target of Ti, a supply of $N_2$ gas at 84 sccm, and a supply of Ar gas at 56 sccm. The second conductive film 15 corresponds to an emitter electrode. The second conductive film 15 may be made of Mo, Cr, Ti, or W, instead of TiN.

Figure 1H:
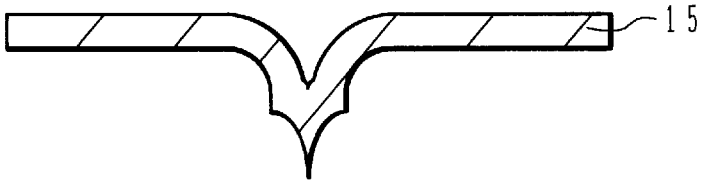

The substrate 10 is wet etched by HF+$HNO_3$+$H_2O$, and thereafter the first and second insulating films 11*a* and 14 are wet etched by HF+$NH_4F$ to expose an emitter electrode 15 as shown in FIG. 1H.

Figure 19A:
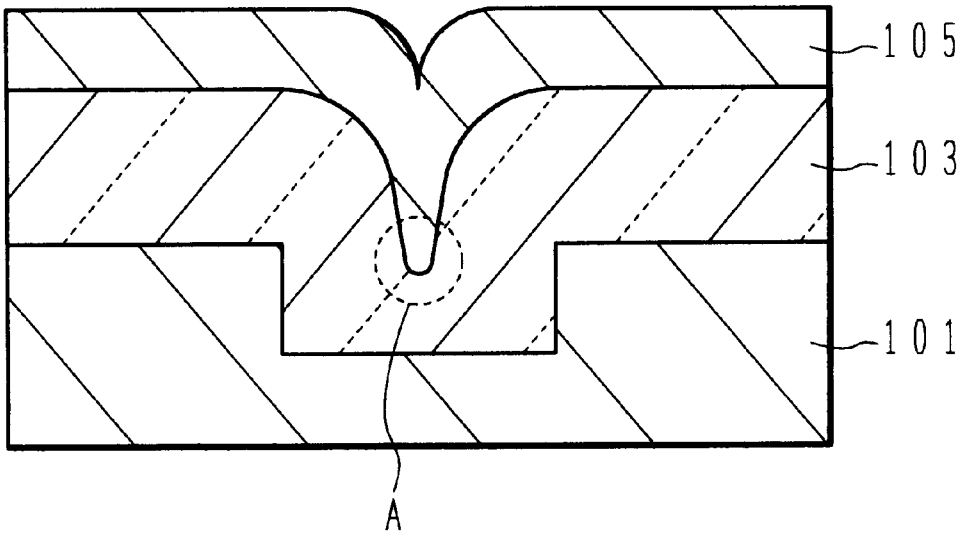
FIG.19A PRIOR ART
FIGS. 19A and 19B are cross sectional views of conventional field emission elements.
Figure 19B:
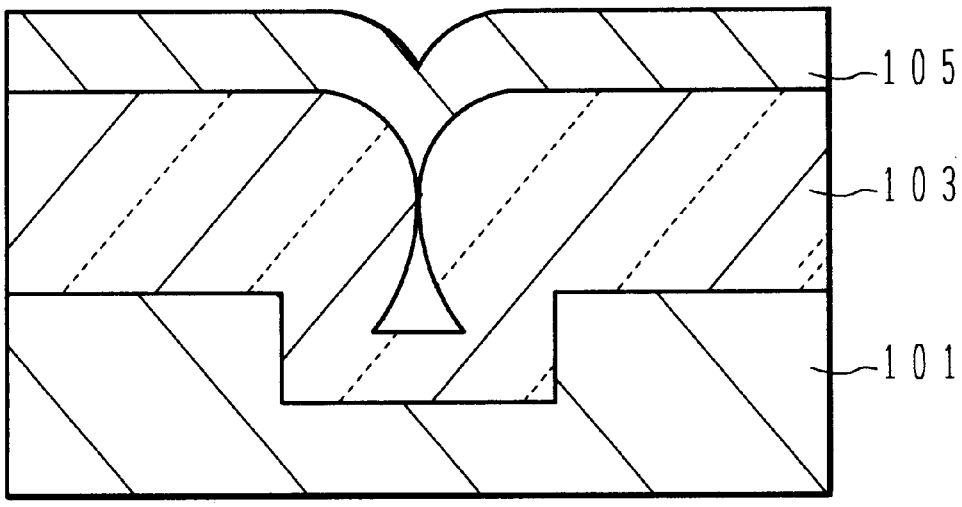
FIG.19B PRIOR ART

The emitter electrode 15 with the two-stage shaped structure can be formed by the above-described manufacture method of this embodiment. As compared to the emitter electrode having a single-stage structure shown in FIGS. 19A and 19B, the emitter electrode of the two-stage shaped structure can easily have a tip with a small radius of curvature and apex angle, so that an electric field concentrates easily at the tip of the emitter electrode and the electric performance of the field emission element can be improved.

The mold for an emitter electrode of the single-stage structure has a shape gradually narrowing its emitter tip region from the base to the end thereof. It is therefore not easy to fill (deposit) emitter material (second conductive film) to the end of the emitter tip region gradually narrowing. In contrast, the mold for an emitter electrode of the two-stage shaped structure has a shape constituted of first and second curved structures. Accordingly, as compared to the single-stage structure with a gradually narrowing single-stage shape, a broader area can be provided at the boundary between the first and second stage structures so that emitter material can be easily filled in down to the end of the emitter tip. The tip of the emitter electrode of the two-stage shaped structure is not likely to be broken and the shape of the mold can be formed with good reproductivity.

If the element shown in FIG. 1(, is used as a two-electrode element or a three-electrode element, the first conductive film 12*a* is used as a gate electrode. However, if the element shown in FIG. 1G is used only for an emitter electrode, the first conductive film 12*a* is etched and removed so that it is not necessary to use conductive material but insulating material may be used.

Furthermore, if an emitter electrode only is to be used, the first insulating layer 11*a* shown in FIG. 1G is not necessary to be formed between the first conductive film 12*a* (gate electrode) and substrate 10 (anode electrode), but the first conductive film 12*a* may be formed directly on the substrate 10. In this case, the substrate 10 may be made of either conductive material or insulating material.

The same etching rate is not always required for the first insulating and sacrificial films 11 and 13 shown in FIG. 1C, so long as the etching rates thereof are faster than that of the first conductive film 12*a*.

If the etching rate of the first insulating film 11 is faster than that of the first conductive film 12*a*, the recess 11*b* (FIG. 1E) can be formed deep into the first conductive film 11*a* from the upper surface thereof. If the etching rate of the first sacrificial film 13 is faster than that of the first conductive film 12*a*, the side spacer 13*c* (FIG. 1E) can be formed only on the lower side wall of the recess so that an emitter electrode having the two-stage shaped structure can be formed.

Figure 2A:
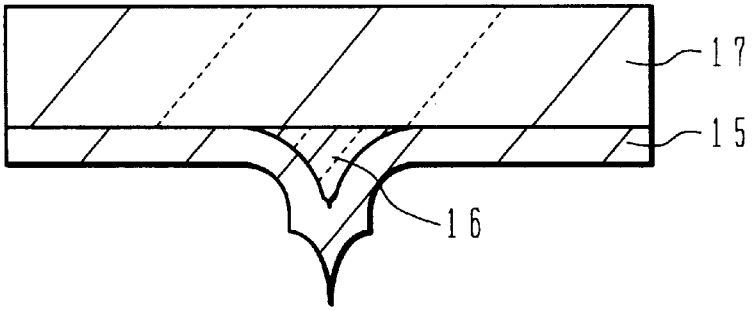
FIGS. 2A to 2C are diagrams illustrating three methods of reinforcing an emitter electrode by using a support substrate according to the first embodiment.
Figure 2B:
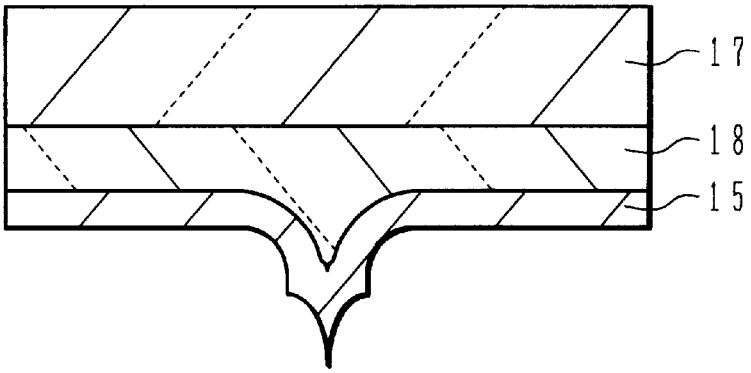
Figure 2C:
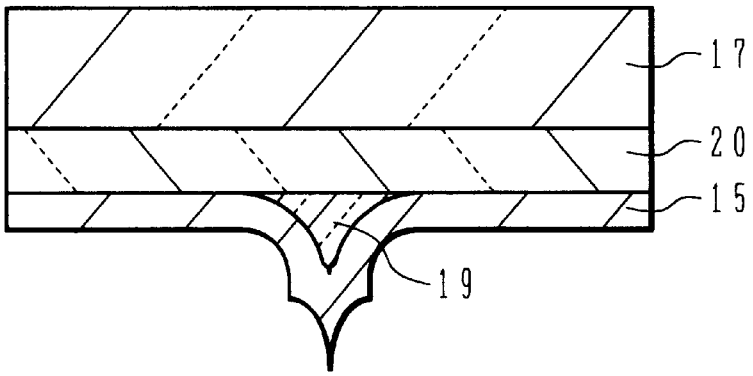

FIGS. 2A to 2C are cross sectional views illustrating three kinds of a method of reinforcing an emitter electrode 15 by using a support substrate 17. Since the emitter electrode 15 is as thin as about 0.05 $\mu$m, it is desired to reinforce the emitter electrode 15 with the support substrate 17.

FIG. 2A illustrates the first method. A bottom recess of the emitter electrode 15 manufactured as shown in FIG. 1G is filled with a planarizing film 16 of, for example, SOG.

Thereafter, the planarizing film 16 is etched back by chemical mechanical polishing (CMP) to planarizt the bottom surface of the emitter electrode 15. The planarizing film 16 may be formed by reflowing PSG (phosphosilicate glass) or BPSG (borophosphosilicate glass) instead of using the SOG film.

Next, a support substrate 17 is adhered to the emitter electrode 15. The support substrate 17 is made of, for example, glass, quartz, or $Al_2O_3$. Thereafter, the process illustrated in FIG. 1H is performed to remove the substrate 10 and first and second insulating films 11*a* and 14.

FIG. 2B illustrates the second method. Adhesive 18 such as low melting point glass is flowed on the emitter electrode 15 in the state shown in FIG. 1G to adhere the emitter electrode 15 and a support substrate 17 together. The adhesive 18 also functions to planarize the bottom surface of the emitter electrode 15. Thereafter, the process illustrated in FIG. 1H is performed to remove the substrate 10 and first and second insulating films 11*a* and 14.

Instead of the low melting point glass, Al may be used as the adhesive 18. In this case, the emitter electrode 15 and support substrate 17 may be adhered together by anodic bonding using electrostatic forces generated upon application of a high voltage of 1 kV between the support substrate 17 and adhesive 18 (or emitter electrode 15) and maintaining the temperature at 400 to 500° C. If Al is used as the adhesive 18, this Al layer may be used as an emitter wiring.

FIG. 2C illustrates the third method. The bottom recess of the emitter electrode 15 in the state shown in FIG. 1G is filled with a planarizing film 19 made of, for example, W. Thereafter, the planarizing film 19 is etched back to planarize the bottom surface of the emitter electrode 15. A support substrate 17 is adhered to the emitter electrode 15 by using adhesive 20 such as Al. Thereafter, the process illustrated in FIG. 1H is performed to remove the substrate 10 and first and second insulating films 11*a* and 14.

The emitter electrode manufacture methods have been described so far. Next, a method of manufacturing another type of a field emission element, a two-electrode element (so-called a diode), will be described. The two-electrode element has two electrodes, an emitter electrode and a gate electrode.

Figure 3:
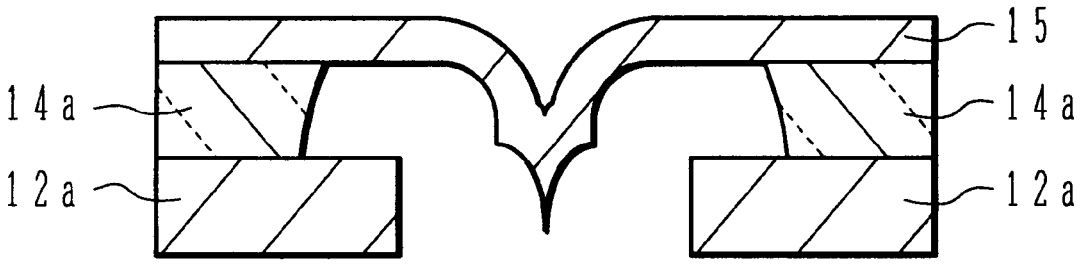
FIG. 3 is a cross sectional view illustrating the manufacture steps of a two-electrode field effect emission element according to the first embodiment.

FIG. 3 is a cross sectional view illustrating the method of manufacturing a two-electrode element. First, an element shown in FIG. 1G is formed by the above described processes. Thereafter, all of the substrate 10, first insulating film 11*a* and side spacer 13*c* are etched and part of the second insulating film 14 is etched from the lower side. By partially removing the second insulating film 14 and leaving the second insulating film 14*a* shown in FIG. 3, the tip of the emitter electrode 15 is exposed.

The conductive film 12*a* forms the gate electrode. The two-electrode element has two electrodes—the emitter electrode 15 and gate electrode 12*a*. The second insulating film 14*a* electrically isolates the emitter electrode 15 and gate electrode 12*a*.

A relative position of the emitter electrode 15 and gate electrode 12*a* is an important factor determining the electric performance of a two-electrode element. A shorter distance between the emitter electrode 15 and gate electrode 12*a* is principally better. It is therefore desired to position the tip of the emitter electrode 15 near on a straight line interconnecting the two parts in section of the gate electrodes 12*a*.

Figure 4A:
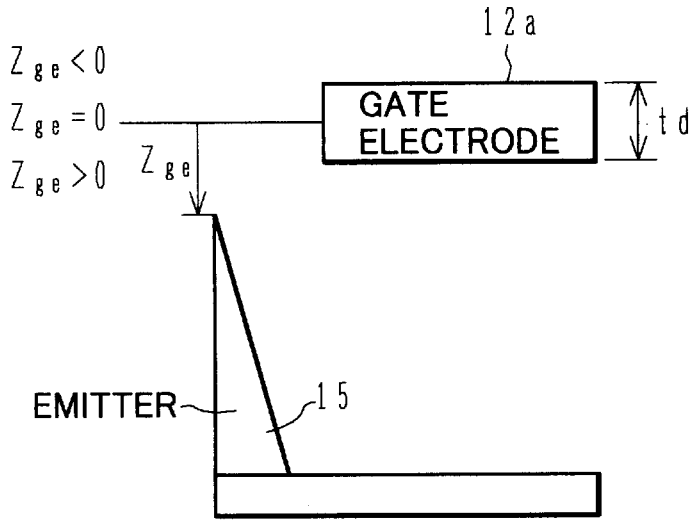
FIG. 4A is a schematic diagram showing a relative position of emitter and gate electrodes.

FIG. 4A is a schematic diagram showing the relative position of the gate electrode 12*a* arid emitter electrode 15. The relative position is turned upside down from that shown in FIG. 3. A distance Zge is a distance from the tip of the emitter electrode 15 to the center of a thickness td of the gate electrode 12*a*, along an electron emission direction, the positive direction of the distance being directed downward as shown in FIG. 4A.

Figure 4B:
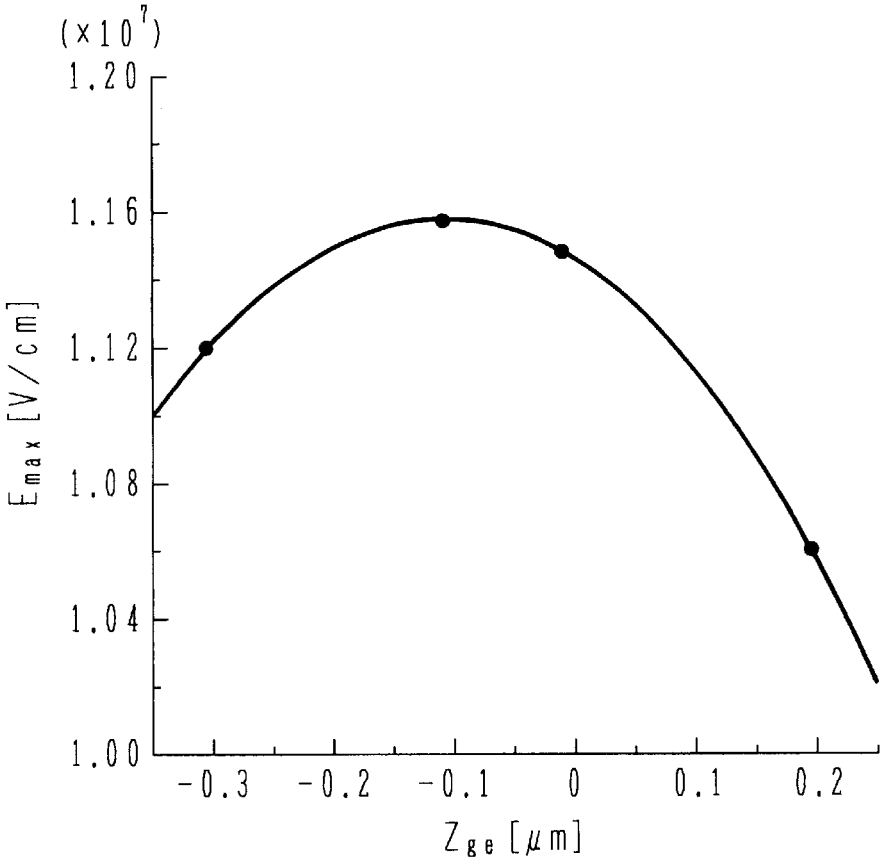
FIG. 4B is a graph showing a relationship between a distance between emitter and gate electrodes and a maximum electric field intensity.

FIG. 4B is a graph showing a relationship between the distance Zge and a maximum electric field intensity Emax at the tip of the emitter electrode 15, with the thickness td of the gate electrode 12*a* being fixed to 0.4 $\mu$m. The abscissa represents the distance Zge, and the ordinate represents the maximum electric field intensity Emax.

This graph shows a change in the maximum field intensity Emax of the emitter electrode as the distance Zge between the emitter and gate electrodes is changed from −0.35 $\mu$m to +0.25 $\mu$m. The larger the maximum field intensity Emax, the more the electric field concentrates on the tip of the emitter electrode and the more the performance of the field emission element is improved. At the distance Zge of −0.1 $\mu$m, the maximum field intensity Emax takes an extreme value of $1.16\times10^7$ V/cm. Namely, the optimum position of the tip of the emitter electrode 15 is slightly higher in FIG. 4A (slightly lower in FIG. 3) than the center of the thickness of the gate electrode.

The two-electrode element uses the emitter electrode 15 as a cathode and the gate electrode 12*a* as a control electrode. If the tip of the emitter electrode 15 is set to a proper position, electrons can be easily emitted from the tip of the emitter electrode 15 even at a low control voltage applied to the gate electrode.

The distance Zge can be regulated by adjusting the etch-back amount of the side spacer 13*c* (FIG. 1E) and/or the thickness of the deposited second insulating film 14 (FIG. 1F).

In the two-electrode element, the emitter electrode 15 also has the two-stage shaped structure and a small apex angle and radius of curvature of the tip so that the performance of the field emission element can be improved.

It is preferable to reinforce the two-stage shaped element with a support substrate by the methods illustrated in FIGS. 2A to 2C.

The manufacture method of a two-electrode element has been described. Next, a manufacture method or another type of a field emission element, a three-electrode element (so-called a triode), will be described.

Figure 5A:
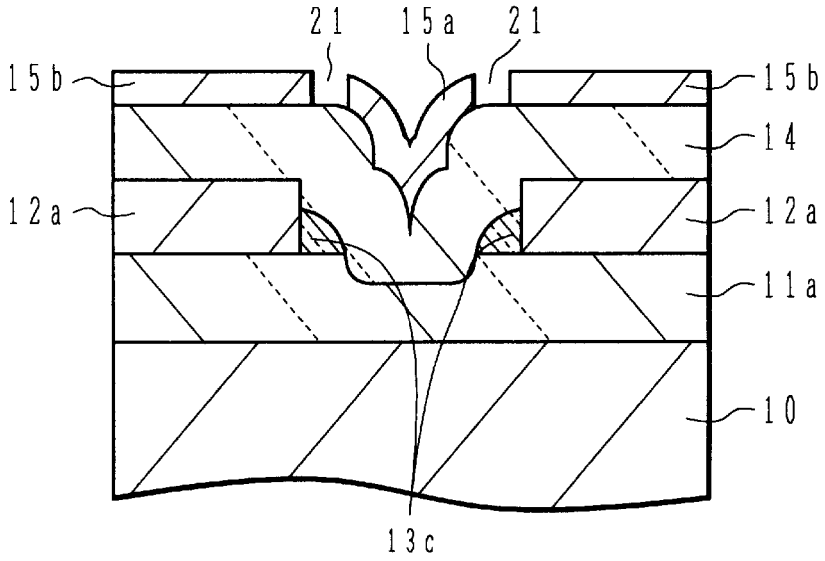
FIGS. 5A and 5B are cross sectional views illustrating the manufacture steps of a three-electrode field effect emission element according to the first embodiment.
Figure 5B:
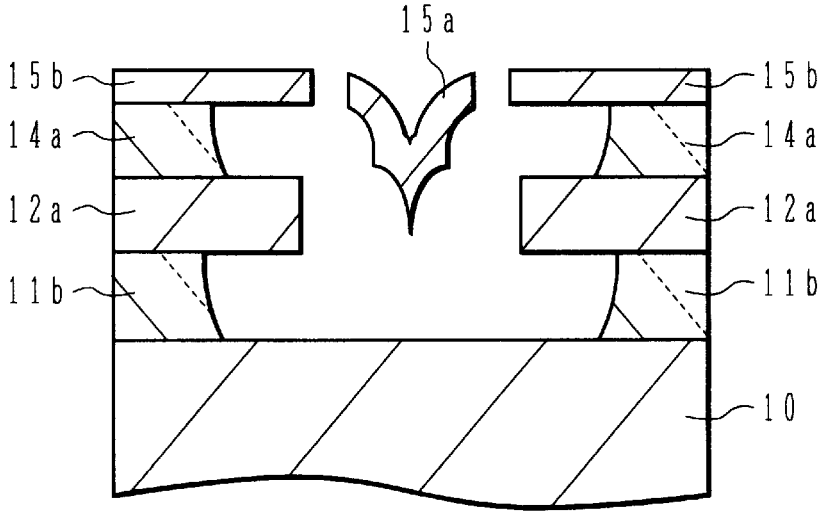

FIGS. 5A and 5B are cross sectional views illustrating a method of manufacturing a three-electrode element. First, the element shown in FIG. 1G is manufactured by the previously described processes.

Thereafter, a resist film (not shown) having a predetermined pattern is formed on the emitter electrode 15. By using this resist pattern as a mask, slit openings 21 are formed on both sides of an emitter electrode 15*a* by RIE using $Cl_2$ containing etchant, as shown in FIG. 5A. An emitter electrode 15*b* is formed at the outer sides of the slit openings 21.

Next, part of the first and second insulating films 11*a* and 14 and the whole of the side spacer 13*c* are wet etched from the upper side, to expose the tip of the emitter electrode 15*a* and leave the peripheral first arid second insulating films 11*b* and 14*a* for retaining a sufficient support force, as shown in FIG. 5B. For example, $HF+NH_4F$ is used for wet etching the first and second insulating films 11*a* and 14 and side spacer 13*c* made of $SiO_2$.

With this wet etching, the emitter electrode 15*a*, gate electrode 12*a*, and anode electrode (substrate) 10 are exposed.

Figure 6:
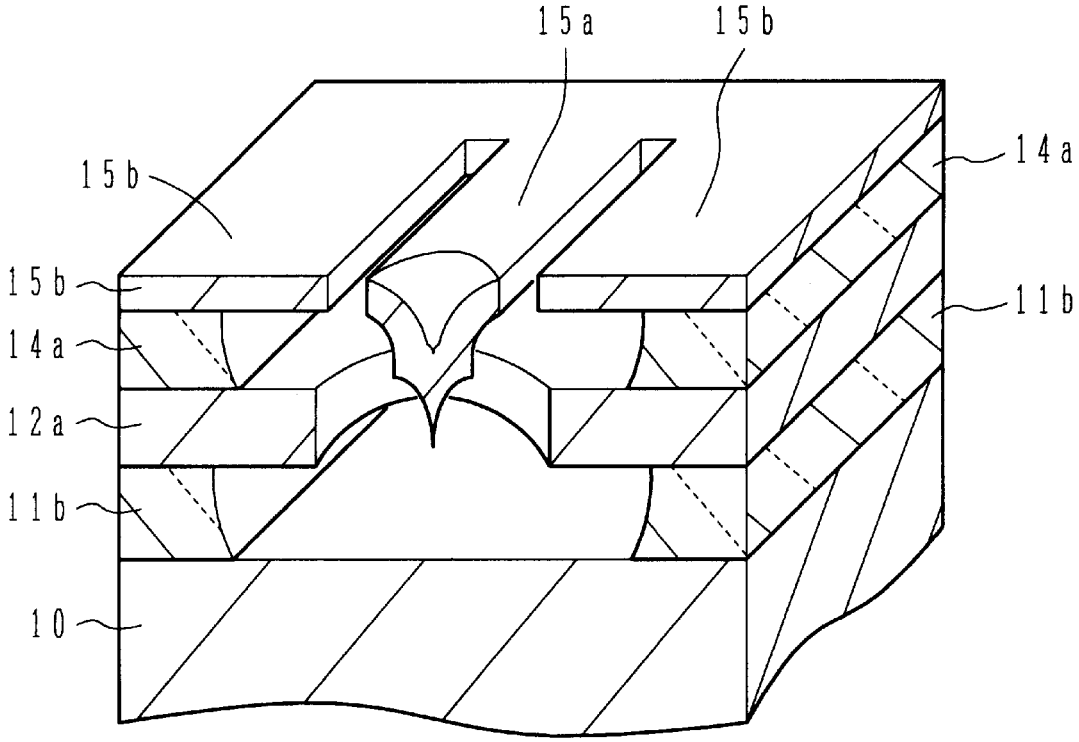
FIG. 6 is a perspective view of a three-electrode field effect emission element according to the first embodiment.

FIG. 6 is a perspective view of a three-electrode element. The emitter electrode 15*a* is integrally formed with the emitter electrode 15*b*. The gate electrode 12*a* has a circular hole (gate hole) near at the tip of the emitter electrode 15*a*. The tip of the emitter electrode 15*a* has a needle-like sharp edge near at the gate hole of the gate electrode 12*a*.

The three-electrode element shown in FIG. 6 has the emitter electrode 15*a* as a cathode and the anode electrode 10 wherein a positive potential is applied to the gate electrode 12*a* to emit electrons from the emitter electrode 15*a* toward the anode electrode 10.

Also in the case of a three-electrode element, the apex angle and radius of curvature of the tip of the emitter electrode 15*a* can be made small. The relative position of the emitter electrode 15*a* and gate electrode 12*a* can be controlled precisely.

FIGS. 7A to 7I are cross sectional diagrams illustrating the manufacture steps of a field emission element according to the second embodiment of the invention. In the following, the manufacture steps of an emitter constituting a field emission element will be described.

Figure 7A:
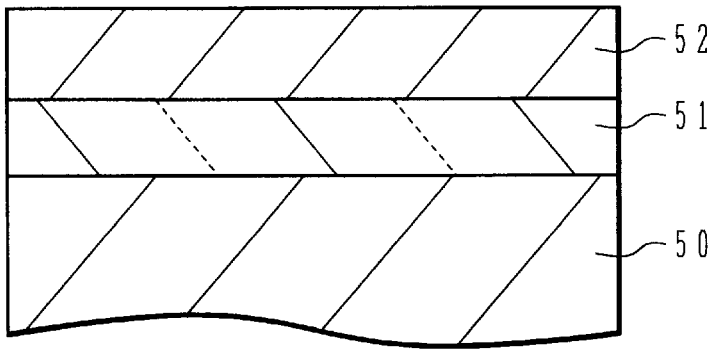
FIGS. 7A to 7I are cross sectional views illustrating the manufacture steps of a field emission element according to a second embodiment of the invention.

As shown in FIG. 7A, a substrate 50 is made of Si, for example. A first insulating film 51 of $SiO_2$ is formed through thermal oxidation on the surface of the substrate 50. The substrate 50 may be made of Al instead of Si. If the substrate 50 is made of Al, the first insulating film 51 may be made of $Al_2O_3$.

The thermal oxidation may be performed, for example, by using a vertical furnace under the conditions of a furnace temperature of 1000° C., an $H_2$ gas flow of 19 slm and an $O_2$ gas flow of 19 slm.

A first conductive film 52 corresponding to a gate electrode is deposited on the surface of the first insulating film 51. The first conductive film 52 may be made of polysilicon doped with P or B which can be deposited through low pressure CVD. For example, the low pressure CVD may be performed by supplying He diluted $SiH_4$ at a flow rate of 0.6 slm under the conditions of a temperature of 625° C. and a pressure of 30 Pa. In order to dope B or P, diborane or phosphine is supplied. Instead of polysilicon, the first conductive film 52 may be made of amorphous silicon, $WSi_x$, $MoSi_x$, $TaSi_x$, Al, Cu or W.

Figure 7B:
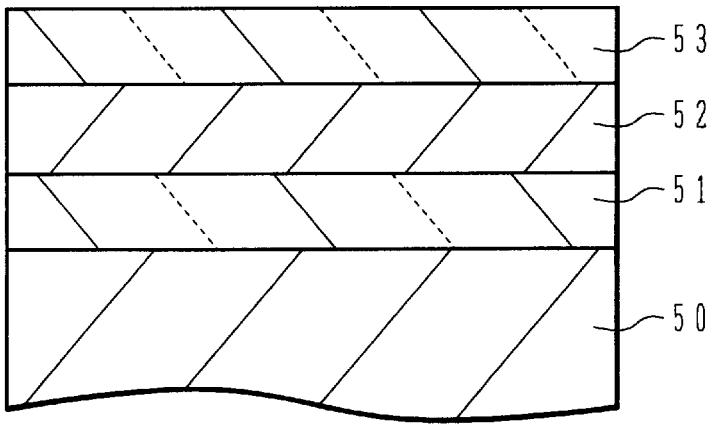

Next, as shown in FIG. 7B, on the first conductive film 52, a second insulating film 53 of $SiN_x$ is formed. The second insulating film 53 is made of material having an etching rate slower than the first insulating film 51. The $SiN_x$ film can be formed by plasma CVD. For example, the plasma CVD may be performed by supplying $SiH_4$, at 35 sccm and $N_2$ at 500 sccm under the conditions of a temperature of 415° C., a power of 300 W and a pressure of 1 Torr.

Figure 7C:
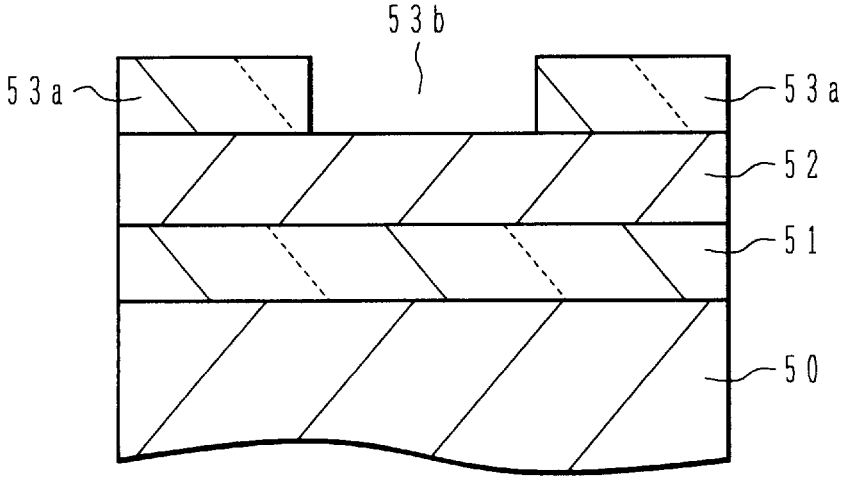

Next, a resist film (not shown) having a predetermined pattern is formed on the second insulating film 53. By using the resist pattern as a mask, the second insulating film 53 is selectively etched to form a hole 53*b* having a first height and a first diameter, as shown in FIG. 7C. The unetched second insulating film 53*a* has two laterally separated parts as viewed in section.

Figure 7D:
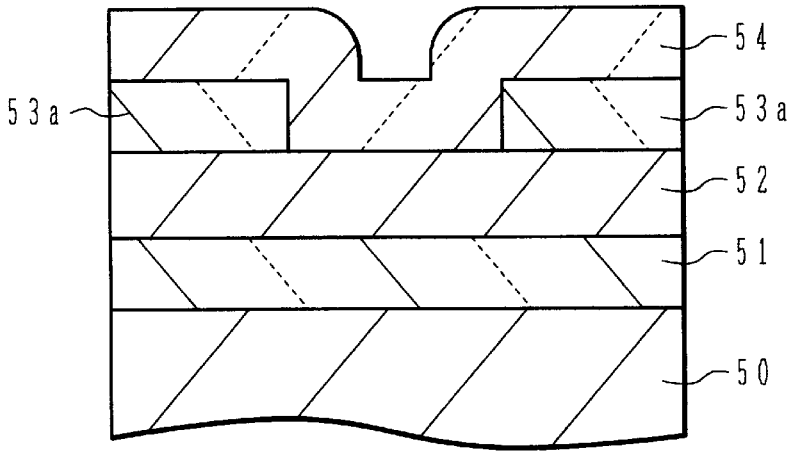

Next, as shown in FIG. 7D, a first sacrificial film 54 made of, for example, $SiO_2$ is deposited on the substrate. This first sacrificial film 54 is deposited with a deposition method having good step coverage. For example, the first sacrificial film 54 is formed through atmospheric pressure CVD at a substrate temperature of 400° C. by using source materials of TEOS, $O_3$ and $O_2$.

Instead of using $SiO_2$, the first sacrificial film 54 may be made of PSG or BPSG. The material of the first sacrificial film 54 has preferably an etching rate generally equal to that of the first insulating film 51. The materials of the first sacrificial film 54, first insulating film 51, and second insulating film 53*a* are selected so that at least the etching rates of the first sacrificial film 54 and first insulating film 51 are faster than the second insulating film 53*a*. Preferably, the same material is used for the first sacrificial and insulating films 54 and 51. In the following, it is assumed that $SiO_2$ is used for the materials of both the first sacrificial and insulating films 54 and 51.

The etching rates of these films satisfy the following relationship. The etching rates of the first sacrificial and insulating films 54 and 51 are generally the same, and that of the second insulating film 53*a* is lower than the etching rates of the first sacrificial and insulating films 54 and 51.

Figure 7E:
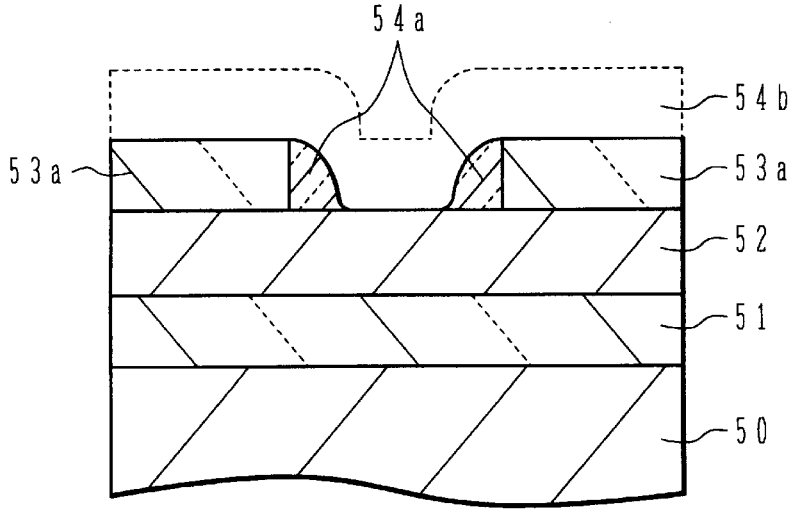

Next, the first sacrificial film 54 of $SiO_2$ is anisotropically etched back through magnetron RIE using a mixed gas of $CHF_3+CO_2+Ar$. As shown in FIG. 7E, the region 54*b* of the first sacrificial film 54 on the flat surface is removed, and the region 54*a* on the side wall of the gate hole is left so that the diameter of the hole is reduced. The region 54*a* constitutes a side spacer formed on the side wall of the hole in the second insulating film 53*a* made of the two parts (laterally separated regions) as viewed in section.

Figure 7F:
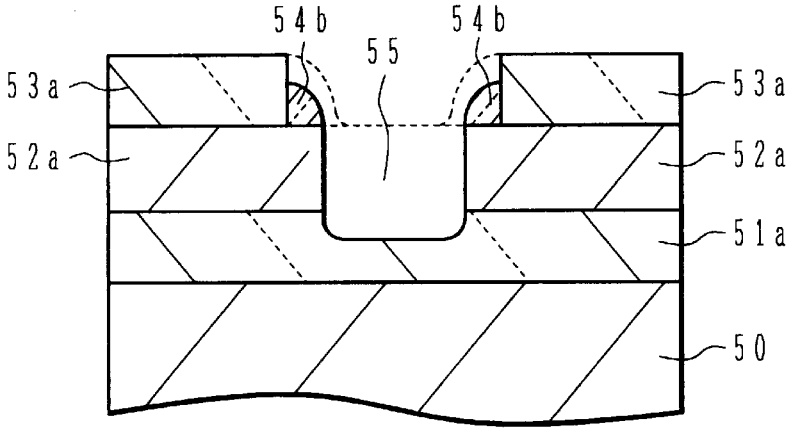

Next, selective etching is performed by using the second insulating film 53*a* and side spacer 54*a* as a mask. As shown in FIG. 7F, a gate hole is formed passing through the first conductive film 52*a* and reaching the first insulating film 51. As the etching further the gate hole 55 is deepened. The first conductive film (gate electrode) 52*a* has two laterally separated parts in cross section which surrounds the gate hole 55. This etching is performed through magnetron RIE using etchant gas of $HBr+Cl_2$.

Since the etching rates of the side spacer 54*a* and first insulating film 51 are faster than that of the second insulating film 53*a*, the selective etching etches the surfaces of the side spacer 54*a* and first insulating film 51 so that a side spacer 54*b* and a first insulating film 51*a* having the shape as shown in FIG. 7F are formed.

With the etching described above, therefore, the side spacer 54*b* is formed on the lower side wall of the recess in the second insulating film 53*a*, with the shape of the second insulating film 53*a* being maintained unchanged. The upper side wall of the second insulating film 53*a* is therefore exposed and a step is formed at the boundary between the exposed upper side wall and the side spacer 54*b*. This step is used for forming an emitter electrode having a two-stage shaped structure.

Figure 7G:
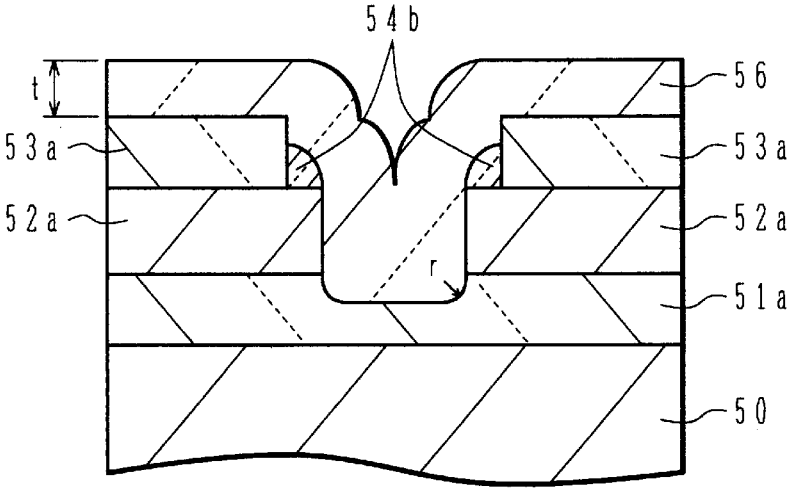

Next, as shown in FIG. 7G, a third insulating film 56 is deposited on the substrate, this film being made of $SiO_2$, for example. The third insulating film 56 is deposited by a deposition method with good step coverage. For example, it may be formed through atmospheric pressure CVD at a substrate temperature of 400° C. by using TEOS, $O_3$ and $O_2$ as source materials. Instead of using $SiO_2$, the third insulating film 56 may be made of $SiN_x$.

Since the third insulating film 56 is deposited with good step coverage, it has a surface shape reflecting topography of the underlying surfaces of the second insulating film 53*a*, side spacer 54*b*, and first conductive and insulating films 52*a* and 51*a*. A valley (cusp) formed on the surface of the third insulating film 56 has a two-stage shaped structure. The first stage structure reflects the corner shape of the recess of the second insulating film 53*a*, and the second stage structure reflects the shape of the side spacer 54*b*. The third insulating film 56 grown from the bottom of the gate hole forms a cusp on the upper surface thereof, the apex of the cusp being a deepest point where side walls of the third insulating film 56 as viewed in cross section contact at the first time.

The thickness t of the third insulating film 56 is set larger than the radius r of curvature of the rounded corner at the bottom of the recess in the first insulating film 51*a*. If the thickness t of the third insulating film 56 is set larger than the radius r, the tip of the cusp of the becomes sharp. This cusp portion is used as a mold for the two-stage shaped emitter electrode.

Figure 7H:
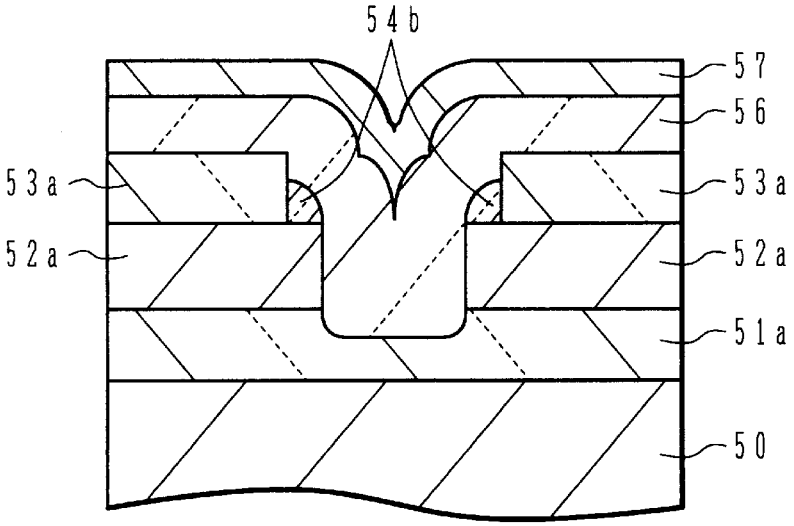

As shown in FIG. 7H, a second conductive film 57 made of, for example, TiN is deposited about 0.05 $\mu$m on the third insulating film 56 through reactive sputtering. For example, the reactive sputtering is performed by using a DC sputtering system under the conditions of a power of 5 kW, a pressure of 4 mTorr, a target of Ti, a supply of $N_2$ gas at 84 sccm, and a supply of Ar gas at 56 sccm. The second conductive film 57 corresponds to an emitter electrode. The second conductive film 57 may be made of Mo, Cr, Ti, or W, instead of TiN.

Figure 7I:
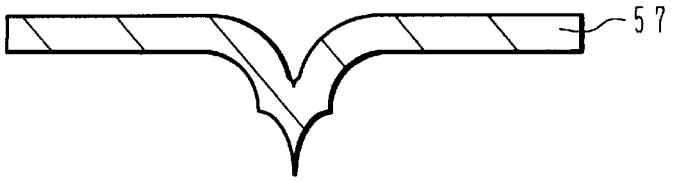

The substrate 50 is wet etched by $HF+HNO_3+H_2O$, and thereafter the first and third insulating films 51*a* and 56 are wet etched by $HF+NH_4F$ to expose an emitter electrode 57 as shown in FIG. 7I.

Preferably, the substrate 50 is mechanically reinforced with a support substrate by the methods described with FIGS. 2A to 2C.

Also in this embodiment, the emitter electrode 57 with the two-stage shaped structure can be formed. As compared to the emitter electrode having a single-stage structure, the emitter electrode of the two-stage shaped structure can easily have a tip with a small radius of curvature and apex angle.

The mold for an emitter electrode of the two-stage shaped structure has a shape constituted of first and second curved structures. Accordingly, as compared to the single-stage structure with a single-stage shape, emitter material can be easily filled in down to the end of the emitter tip. The tip of the emitter electrode of the two-stage shaped structure is not likely to be broken and the shape of the mold can be formed with good reproductivity.

The first conductive film 52*a* shown in FIG. 7H is used as a gate electrode a two-electrode element or a three-electrode element. However, if the element shown in FIG. 7H is used only for an emitter electrode, the first conductive film 52*a* is etched and removed so that it is not necessary to use conductive material but insulating material may be used.

Furthermore, if an emitter electrode only is to be used, the first insulating layer 51*a* shown in FIG. 7H is not necessary to be formed between the first conductive film 52*a* (gate electrode) and substrate 50 (anode electrode), but the first conductive film 52*a* may be formed directly on the substrate 50. In this case, the substrate 50 may be made of either conductive material or insulating material.

The same etching rate is not always required for the first insulating and sacrificial films 51 and 54 shown in FIG. 7D), so long as the etching rates thereof are faster than that of the second insulating film 53*a*.

The emitter electrode manufacture methods have been described so far. Next, a method of manufacturing another type of a field emission element, a two-electrode element (so-called a diode), will be described.

Figure 8:
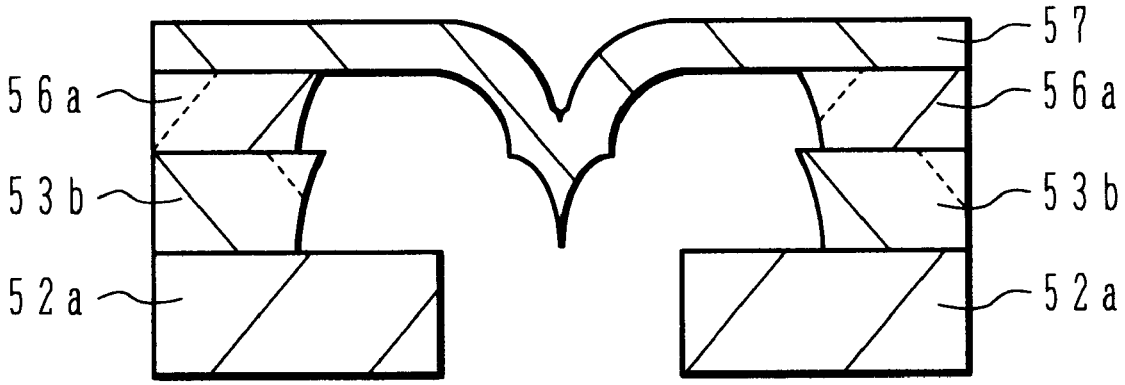
FIG. 8 is a cross sectional view illustrating the manufacture steps of a two-electrode field effect emission element according to the second embodiment.

FIG. 8 is a cross sectional view illustrating the method of manufacturing a two-electrode element. First, an element shown in FIG. 7H is formed by the above described processes. Thereafter, all of the substrate 50, first insulating film 51*a*, and side spacer 54*b* are etched and part of the second and third insulating films 53*a* and 56 is etched from the lower side. By partially removing the second and third insulating films 53*a* and 56 and leaving the second insulating film 53*b* shown in FIG. 8, the tip of the emitter electrode 57 is exposed.

Also in the case of a two-electrode element, it is preferable to reinforce by using a support substrate by the methods illustrated in FIGS. 2A to 2C.

The two-electrode element has two electrodes—the emitter electrode 57 and gate electrode 52*a*. The second and third insulating films 53*b* and 56*a* electrically isolate the emitter electrode 57 and gate electrode 52*a*.

A relative position of the emitter electrode 57 and gate electrode 52*a* is an important factor determining the electric performance of a two-electrode element. This relative position can be easily regulated by adjusting the etch-back amount of the side spacer 54*b* (FIG. 7G) and/or the thickness of the deposited third insulating film 56 (FIG. 7G).

The manufacture method of a two-electrode element has been described. Next, a manufacture method of another type of a field emission element, a three-electrode element (so-called a triode), will be described.

Figure 9A:
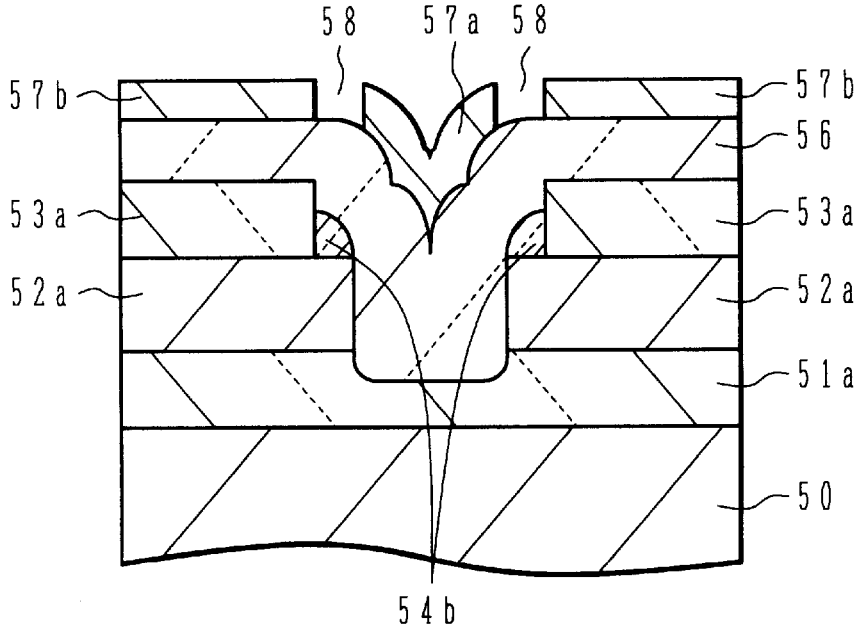
FIGS. 9A and 9B are cross sectional views illustrating the manufacture steps of a three-electrode field effect emission element according to the second embodiment.
Figure 9B:
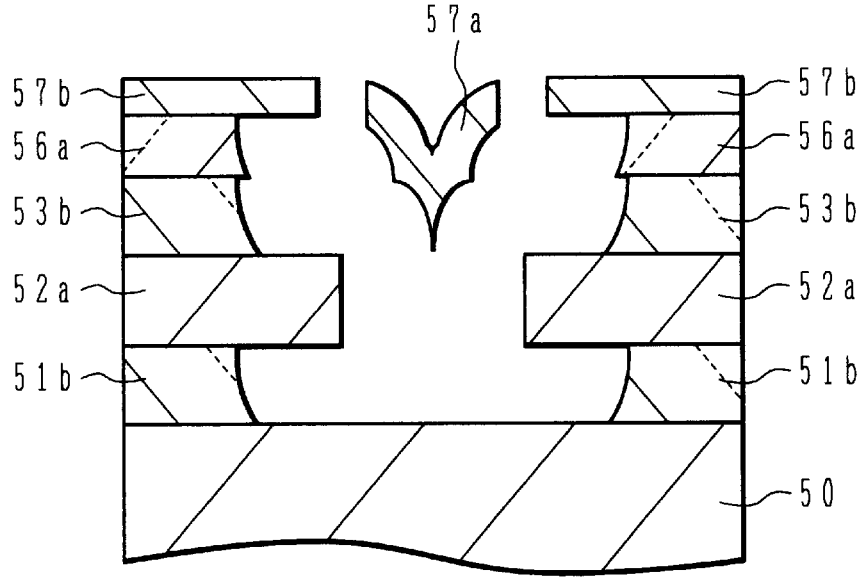

FIGS. 9A and 9B are cross sectional views illustrating a method of manufacturing a three-electrode element. First, the element shown in FIG. 7H is manufactured by the previously described processes. Thereafter, a resist film (not shown) having a predetermined pattern is formed on the emitter electrode 57. By using this resist pattern as a mask, slit openings 58 are formed on both sides of an emitter electrode 57*a* by RIE using $Cl_2$ containing etchant, as shown in FIG. 9A. An emitter electrode 57*b* is formed at the outer sides of the slit openings 58.

Next, part of the third to first insulating films 56, 53*a* and 51*a* and the whole of the side spacer 54*b* are wet etched from the upper side via the slit openings 58, to leave a third insulating film 56*a*, a second insulating film 53*b* and a first insulating film 51b as shown in FIG. 9B. The insulating film of $SiO_2$ may be wet etched by $HF+NH_4F$.

With this wet etching, the emitter electrode 57*a*, gate electrode 52*a*, and anode electrode (substrate) 50 are exposed.

Also in the three-electrode element, the emitter electrode 57*a* can be formed having a small apex angle and radius of curvature. The relative position between the emitter electrode 57*a* and gate electrode 52*a* can be controlled precisely.

Next, the results of simulation of the first embodiment (FIGS. 1A to 1H) will be described. The simulation results verify that the tip of an emitter of the two-stage shaped structure becomes sharp and that the distance Zge between the gate and emitter can be set to an optimum value.

Figure 10:
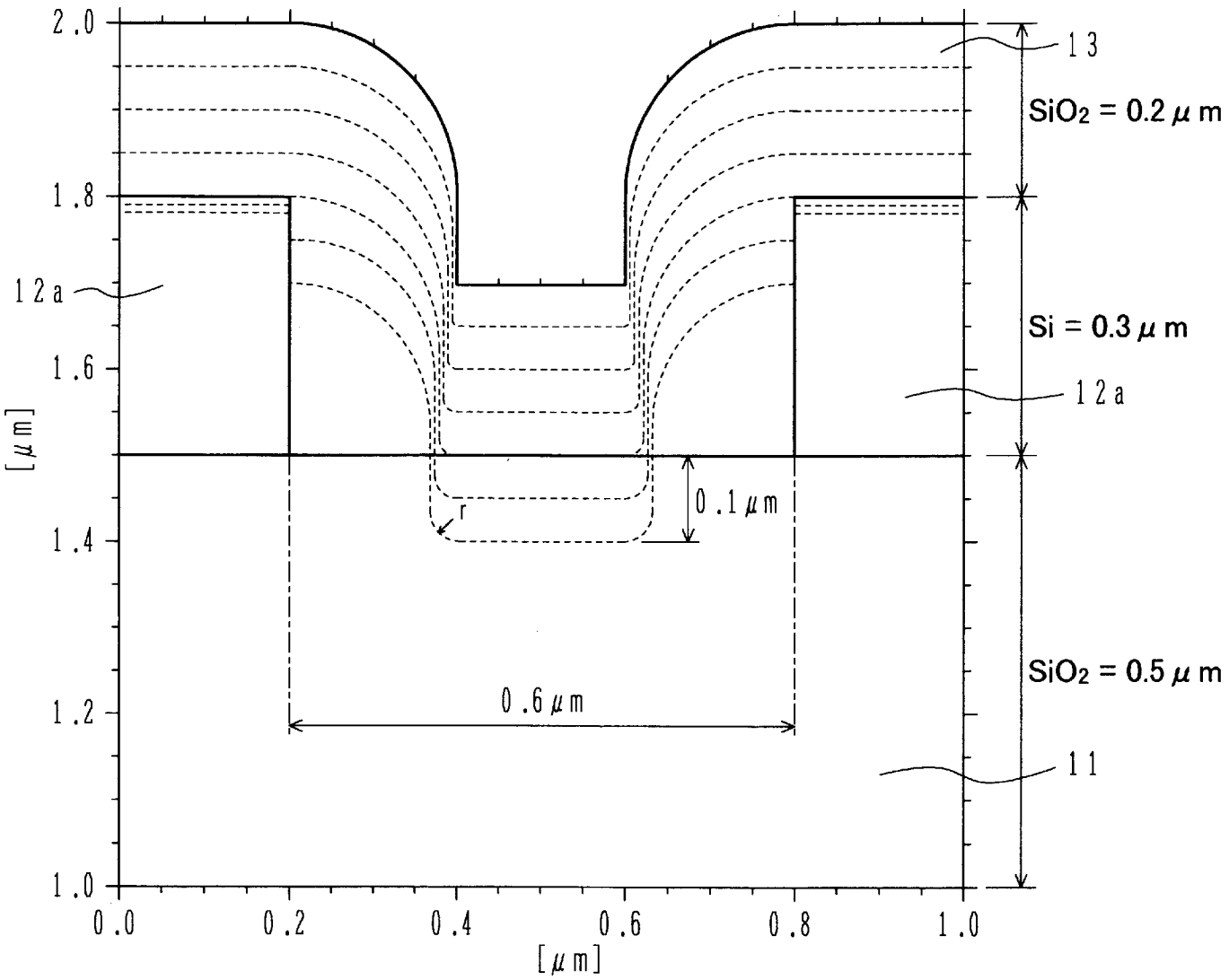
FIGS. 10 to 12 are diagrams showing the simulation results of the first embodiment.

FIG. 10 is a graph illustrating the processes shown in FIGS. 1A to 1E.

On the substrate 10, the first insulating film 11 of $SiO_2$ is deposited 0.5 μm thick, and on this film 11 the first conductive film 12 of polysilicon is deposited 0.3 μm thick (FIG. 1A). Next, the gate hole 12*b* having a diameter of 0.6 μm is formed in the first conductive film 12 (FIG. 1B). Next, the first sacrificial film 13 of $SiO_2$ is deposited 0.2 μm thick (FIG. 1C).

Thereafter, the first sacrificial film 13 is etched back by magnetron RIE (FIGS. 1D and 1E). The change in the shape of the first sacrificial film 13 during the etch-back process is indicated by broken lines. This etch-back process is stopped when the first insulating film 11 is etched by a 0.1 μm thickness. The radius of curvature of the rounded corner at the bottom of the recess in the first insulating film is represented by r. This etch-back slightly etches the upper surface of the second insulating film 12*a*.

An anisotropic factor $A_f$ of the etch-back process is 0.8, and is defined by the following equation.

$$A_f=1-R_i/R_{i+d}$$

where $R_i$ is a lateral etching rate of the first sacrificial film in the recess, and $R_{i+d}$ is a vertical etching rate thereof. If the material of the first sacrificial film shows perfect anisotropy, then $A_f=1$, whereas if it shows perfect isotropy, then $A_f=0$.

Figure 11:
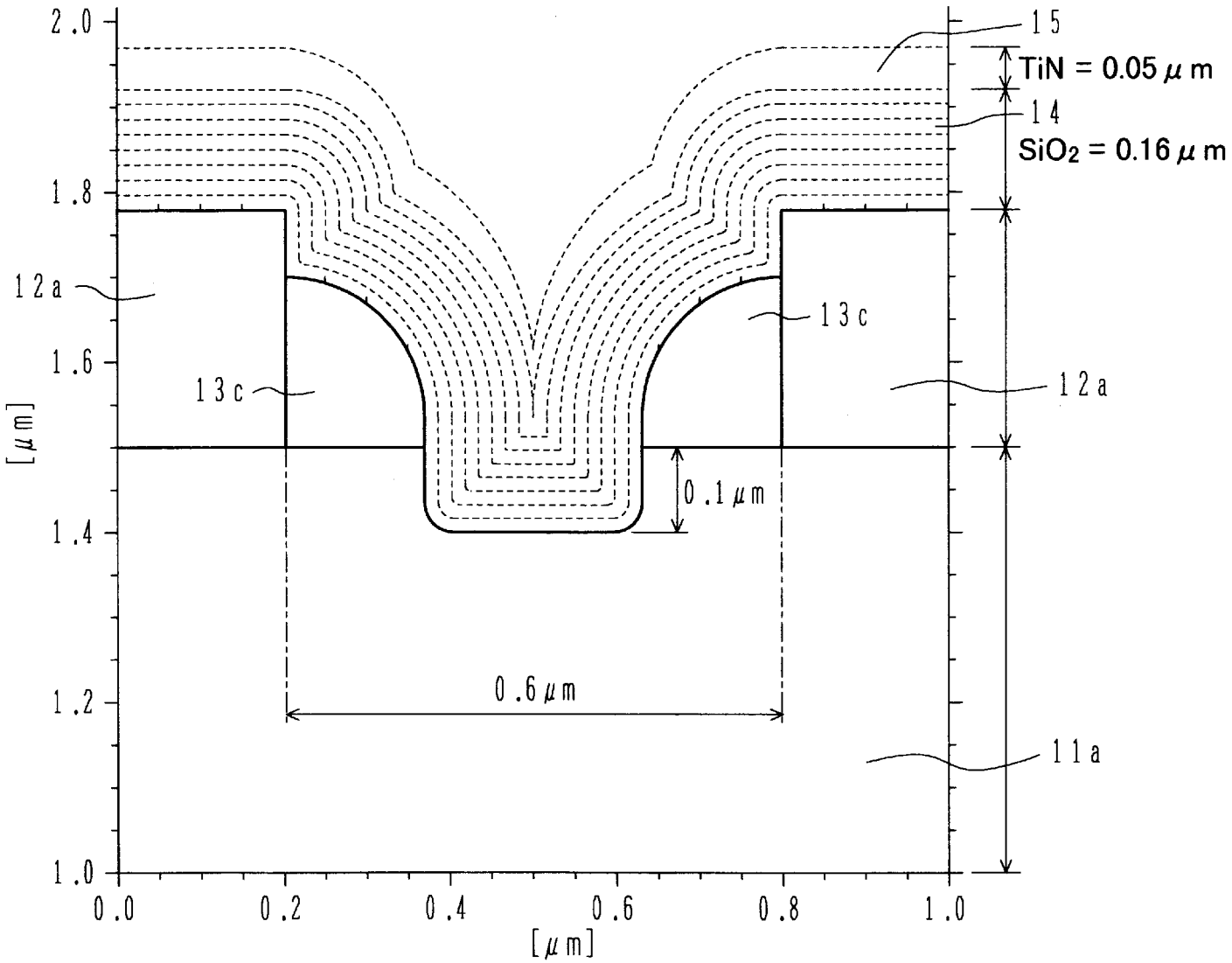

FIG. 11 is a graph showing the final shape of the first sacrificial film after the etch-back. The side spacer 13*c* is a portion of the first sacrificial film 13 unetched by the etch-back process.

Thereafter, the second insulating film 14 of $SiO_2$ is deposited 0.16 μm thick (FIG. 1F). The change in the shape of the second insulating film 14 during the deposition process is indicated by broken lines. While the thickness t of the second insulating film 14 is small, the cusp formed on the upper surface of the second insulating film 14 is not sharp. The second insulating film 14 is deposited to a thickness t larger than the radius r of curvature. As the deposition of the second insulating film 14 progresses, side walls of the two parts in section of the second insulating film 14 contact each other, forming a sharp tip at the bottom of the cusp. This cusp has the two-stage shaped structure.

Thereafter, the second conductive film (emitter electrode) 15 of TiN is deposited 0.05 μm thick (FIG. 1G). The emitter electrode 15 has the two-stage shaped structure with a small apex angle and radius of curvature.

Figure 12:
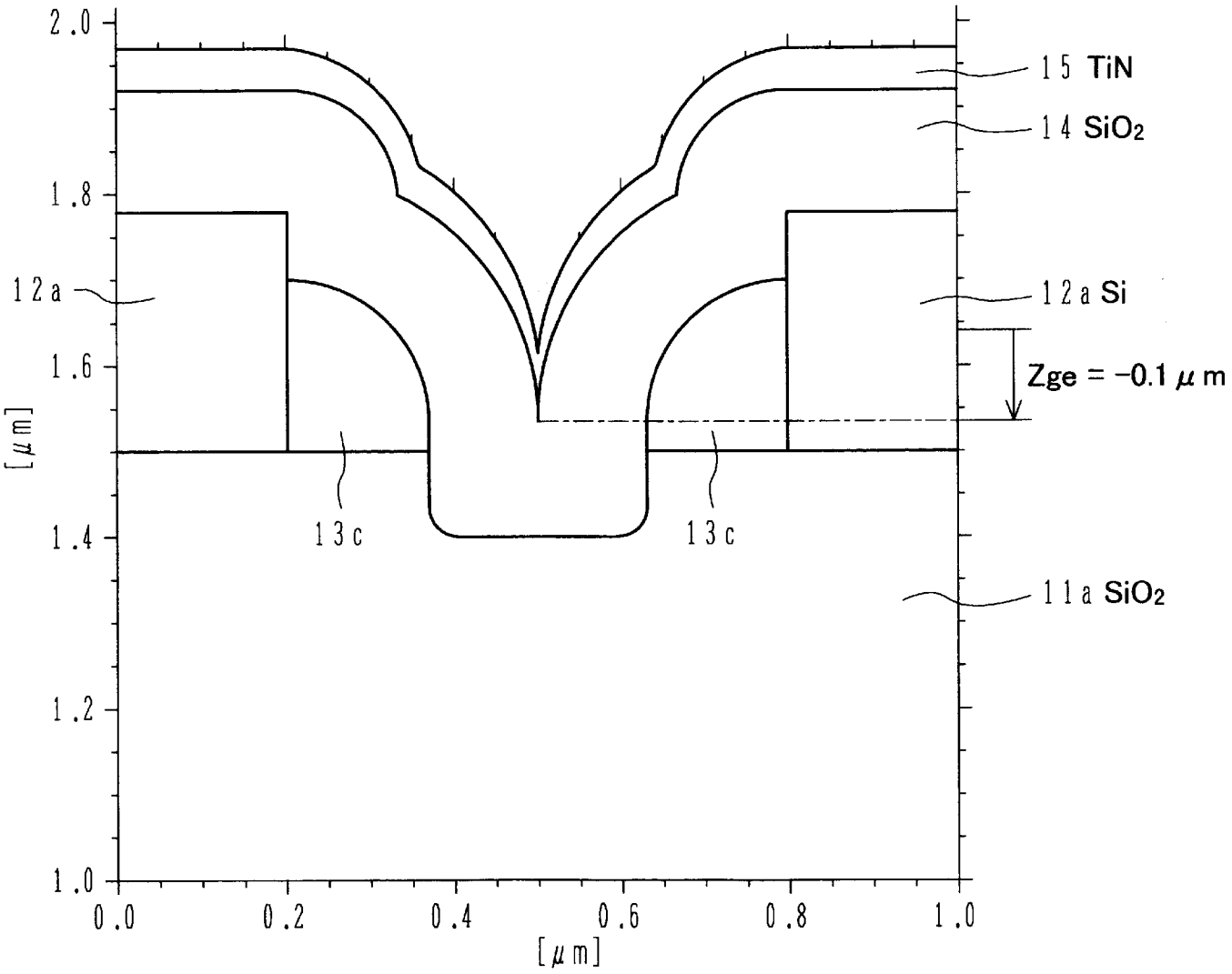

FIG. 12 is a graph showing the shapes of the second insulating film 14 and emitter electrode 15 formed as above. The gate-emitter distance Zge is a distance defined in FIG. 4A. With the above processes, the gate-emitter distance Zge is set to −0.1 μm.

As shown in FIG. 4B, an optimum value of the gate-emitter distance Zge is −0.1 μm. With the distance Zge set to a proper value, electrons can be easily emitted from the tip of the emitter electrode even at a low control voltage applied to the gate electrode. The processes described above can set the gate-emitter distance Zge to an optimum value of −0.1 μm, as shown in FIG. 12.

The gate-emitter distance Zge can be easily regulated by adjusting the etch-back amount of the side spacer 13*c* (FIG. 1E) and/or the thickness of the deposited second insulating film 14 (FIG. 1F).

Next, the other simulation results of the first embodiment will be described by changing the diameter of the gate hole.

Figure 13:
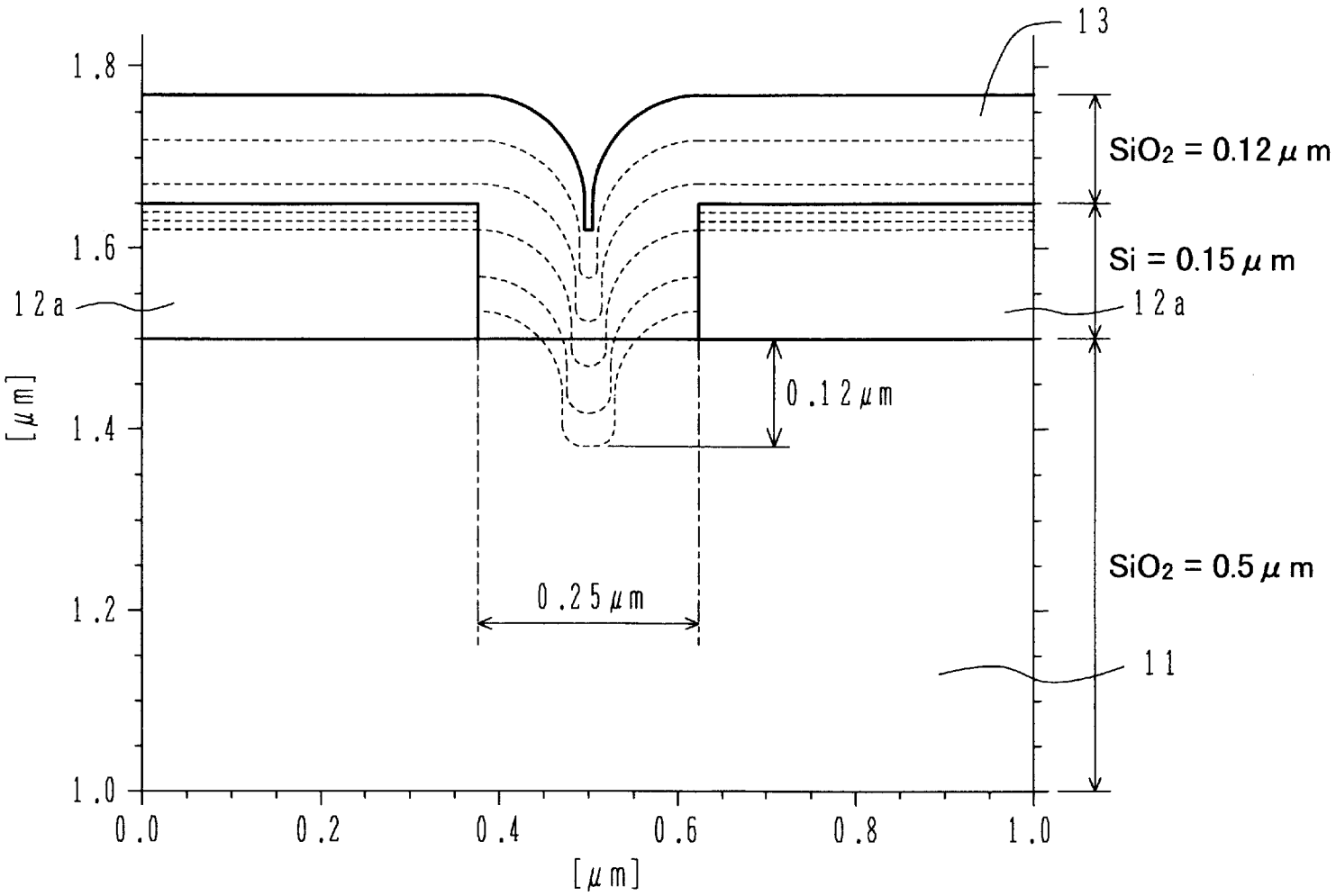
FIGS. 13 to 15 are diagrams showing other simulation results of the first embodiment.

FIG. 13 is a graph illustrating the processes shown in FIGS. 1A to 1E.

On the substrate 10, the first insulating film 11 of $SiO_2$ is deposited 0.5 μm thick, and on this film 11 the first conductive film 12 of polysilicon is deposited 0.15 μm thick (FIG. 1A). Next, the gate hole 12*b* having a diameter of 0.25 μm is formed in the first conductive film 12 (FIG. 1B). Next, the first sacrificial film 13 of $SiO_2$ is deposited 0.12 μm thick (FIG. 1C).

Thereafter, the first sacrificial film 13 is etched back by magnetron RIE (FIGS. 1D and 1E). The change in the shape of the first sacrificial film 13 during the etch-back process is indicated by broken lines. This etch-back process is stopped when the first insulating film 11 is etched by a 0.12 μm thickness. This etch-back slightly etches the upper surface of the second insulating film 12*a*.

Figure 14:
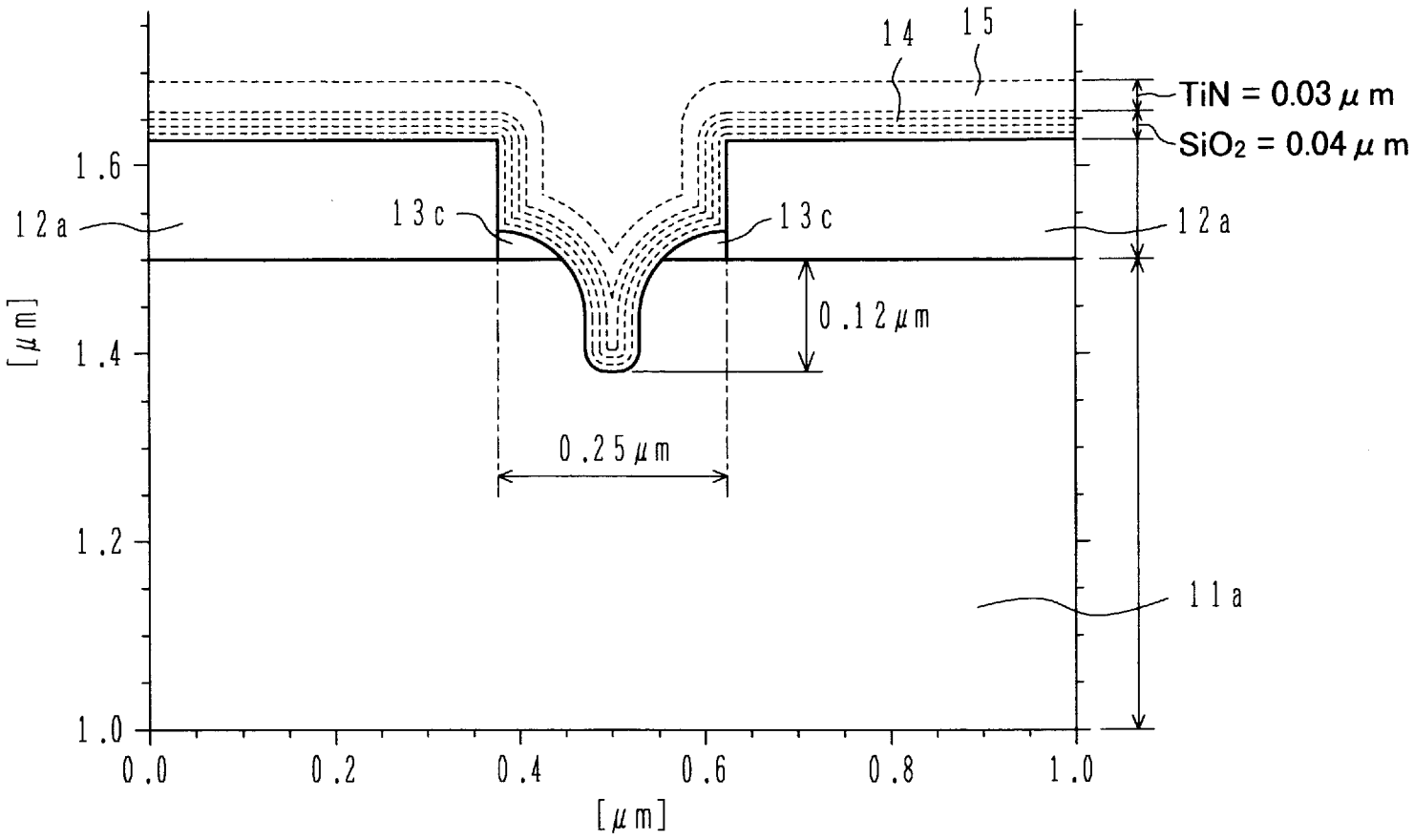

FIG. 14 is a graph showing the final shape of the first sacrificial film after the etch-back. The side spacer 13*c* is a portion of the first sacrificial film 13 unetched by the etch-back process.

Thereafter, the second insulating film 14 of $SiO_2$ is deposited 0.04 μm thick (FIG. 1F). The change in the shape of the second insulating film 14 during the deposition process is indicated by broken lines. While the thickness t of the second insulating film 14 is small, the cusp formed on the upper surface of the second insulating film 14 is not sharp. As the second insulating film 14 is deposited 0.04 μm thick, the tip of the cusp formed on the upper surface of the second insulating film 14 becomes sharp. This cusp has the two-stage shaped structure.

Thereafter, the second conductive film (emitter electrode) 15 of TiN is deposited 0.03 μm thick (FIG. 1G). The emitter electrode 15 has the two-stage shaped structure with a small apex angle and radius of curvature. The emitter electrode of the two-stage shaped structure has a small height of the second stage structure with a smaller diameter. Therefore, it is physically strong and hard to be broken.

Figure 15:
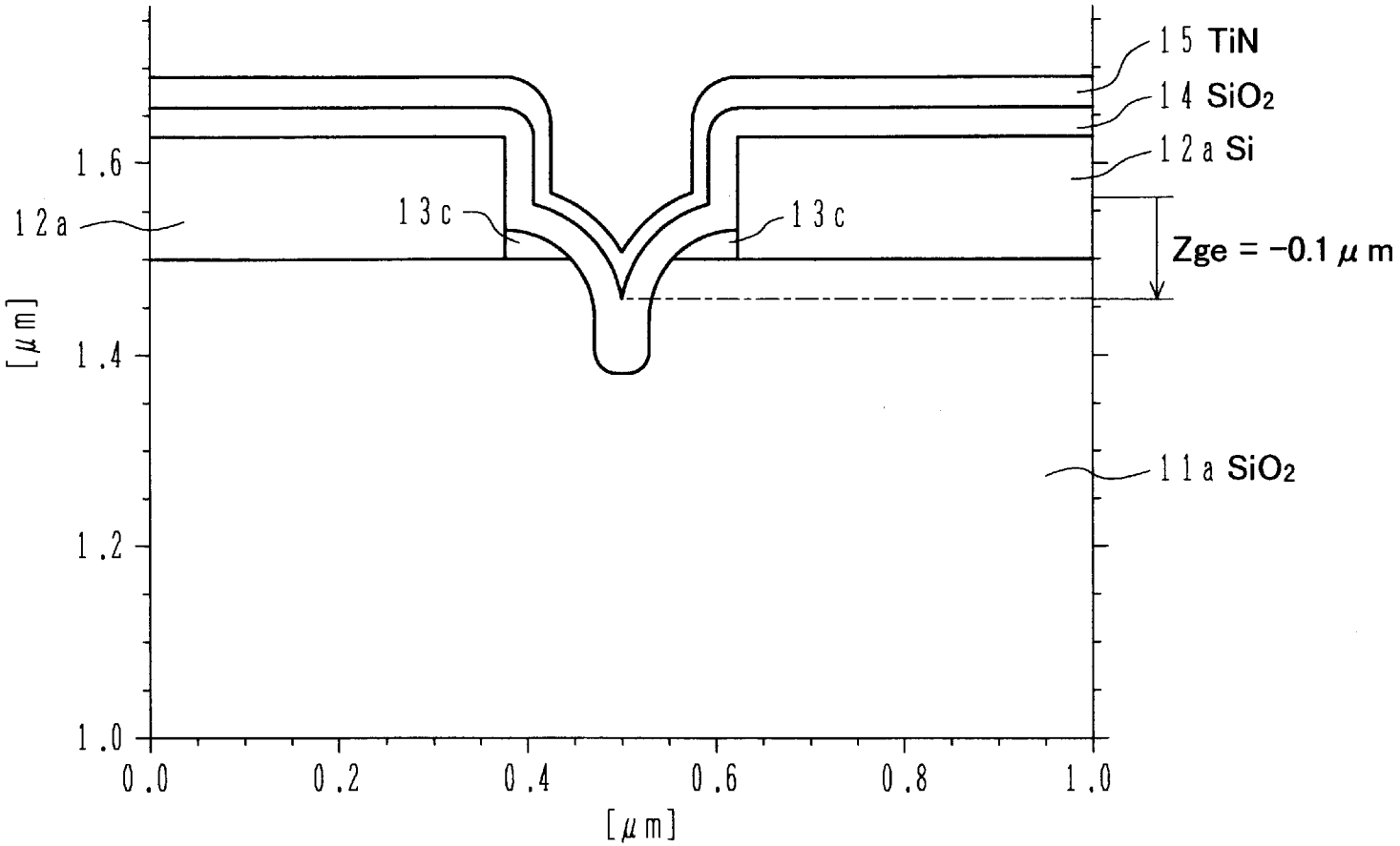

FIG. 15 is a graph showing the shapes of the second insulating film 14 and emitter electrode 15 formed as above. With the above processes, the gate-emitter distance Zge can be set to an optimum value of −0.1 μm.

Figure 16:
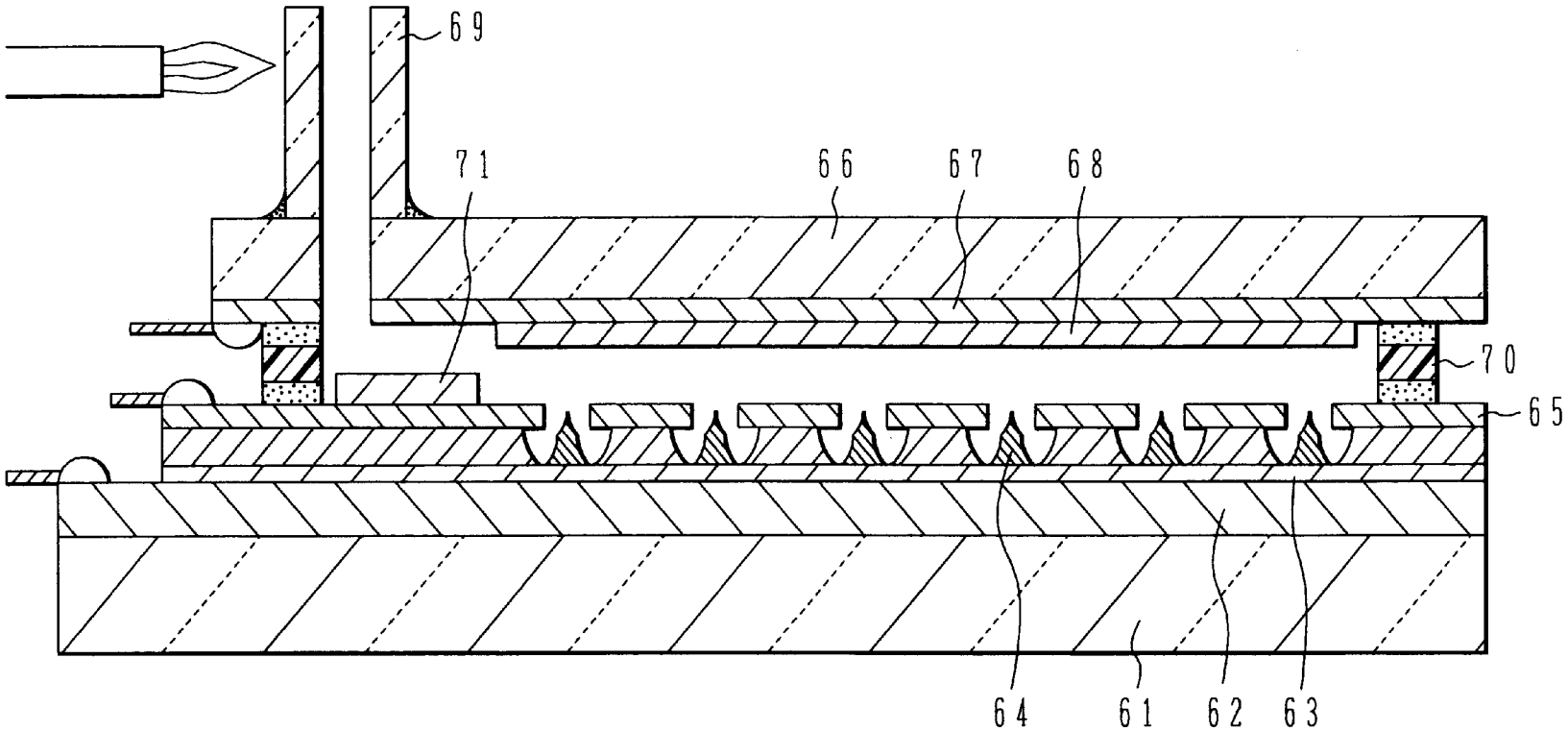
FIG. 16 is a cross sectional view of a flat panel display using field emission elements.

FIG. 16 is a cross sectional view of a flat panel display using field emission elements. Regarding the general knowledge of flat panel displays, reference may be made to U.S. Ser. No. 08/832,095 filed on Apr. 3, 1997 which is incorporated herein by reference.

Each field emission element used is an emitter electrode or a two-electrode element formed by the manufacture method of the above embodiments. Formed on a support substrate 61 made of insulating material, are a wiring Layer 62 made of Al, Cu, or the like and a resistor layer 63 made of polysilicon or the like. On the resistor layer 63, a number of emitter electrodes 64 having a small apex angle and radius of curvature of the emitter tip are disposed to form a field emitter array (FEA). Each gate electrode 65 has an opening (gate hole) near at the tip of each emitter electrode 64 and a voltage can be applied independently to each gate electrode. A plurality of emitter electrodes 64 can also be independently applied with a voltage.

Facing an electron source including the emitter electrode 64 and gate electrode 65, an opposing substrate is disposed including a transparent substrate 66 made of glass, quartz, or the like. The opposing substrate has a transparent electrode (anode electrode) 67 made of ITO or the like disposed under the transparent substrate 66 and a fluorescent member 68 disposed under the transparent electrode 67.

The electron source and opposing substrate are joined together via a spacer 70 made of a glass substrate and coated with adhesive, with the distance between the transparent electrode 67 and emitter electrode 64 being maintained about 0.1 to 5 mm. The adhesive may be low melting point glass.

Instead of the spacer 70 of a glass substrate, a spacer 70 made of adhesive such as epoxy resin with glass beads being dispersed therein may be used.

A getter member 71 is made of Ti, Al, Mg, or the like and prevents emitted gas from attaching again to the surface of the emitter electrode 64.

An air exhaust pipe 69 is coupled to the opposing substrate. By using this air exhaust pipe 69, the inside of the flat display panel is evacuated to about $10_{-5}$ to $10_{-9}$ Torr, and then the air exhaust pipe 69 is seated by using a burner or the like. Thereafter, the anode electrode (transparent electrode) 67, emitter electrode 64, gate electrode 65 are wired to complete the flat panel display.

Figure 17:
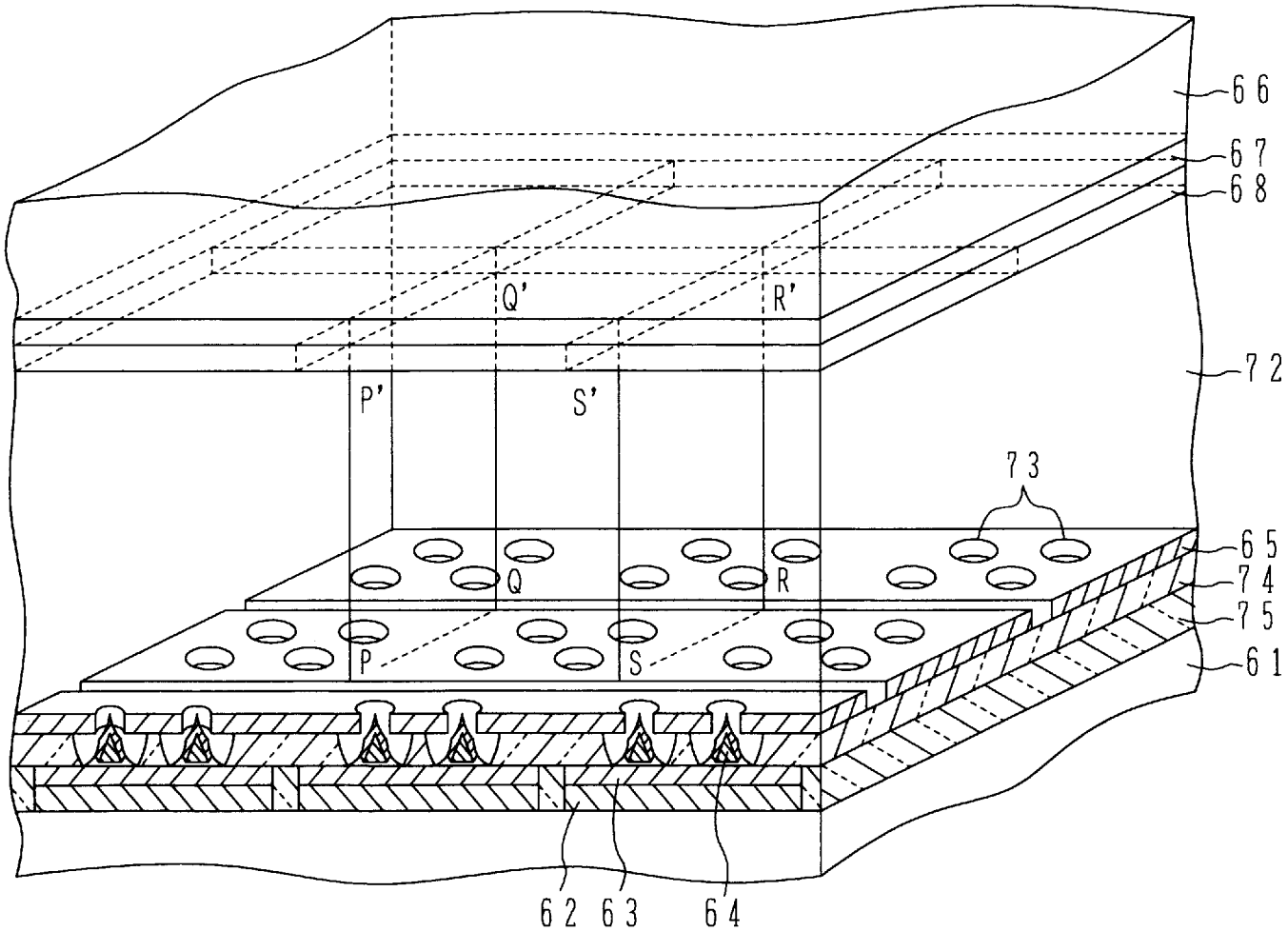
FIG. 17 is a perspective view partially in section of a flat panel display using field emission elements.

FIG. 17 is a perspective view of a flat panel display. A gate electrode 65 has a number of gate holes 73. An emitter electrode 64 is formed in one-to-one correspondence with each gate hole 73. Each emitter electrode is partitioned by an insulating film 74. Electrons emitted from the emitter electrode 64 pass through a vacuum hollow space 72 and collide with a fluorescent member 68 to radiate light therefrom.

The flat panel display is constituted of a plurality of pixels. Each pixel is constituted of a region PQRS made of four emitter electrodes and a corresponding region P'Q'R'S' of the opposing substrate.

A resistor layer 63 and a wiring layer 62 formed under the emitter electrodes 64 are partitioned by a planarizing film (insulating film) 75 in unit of pixel (four emitter electrodes).

Figure 18:
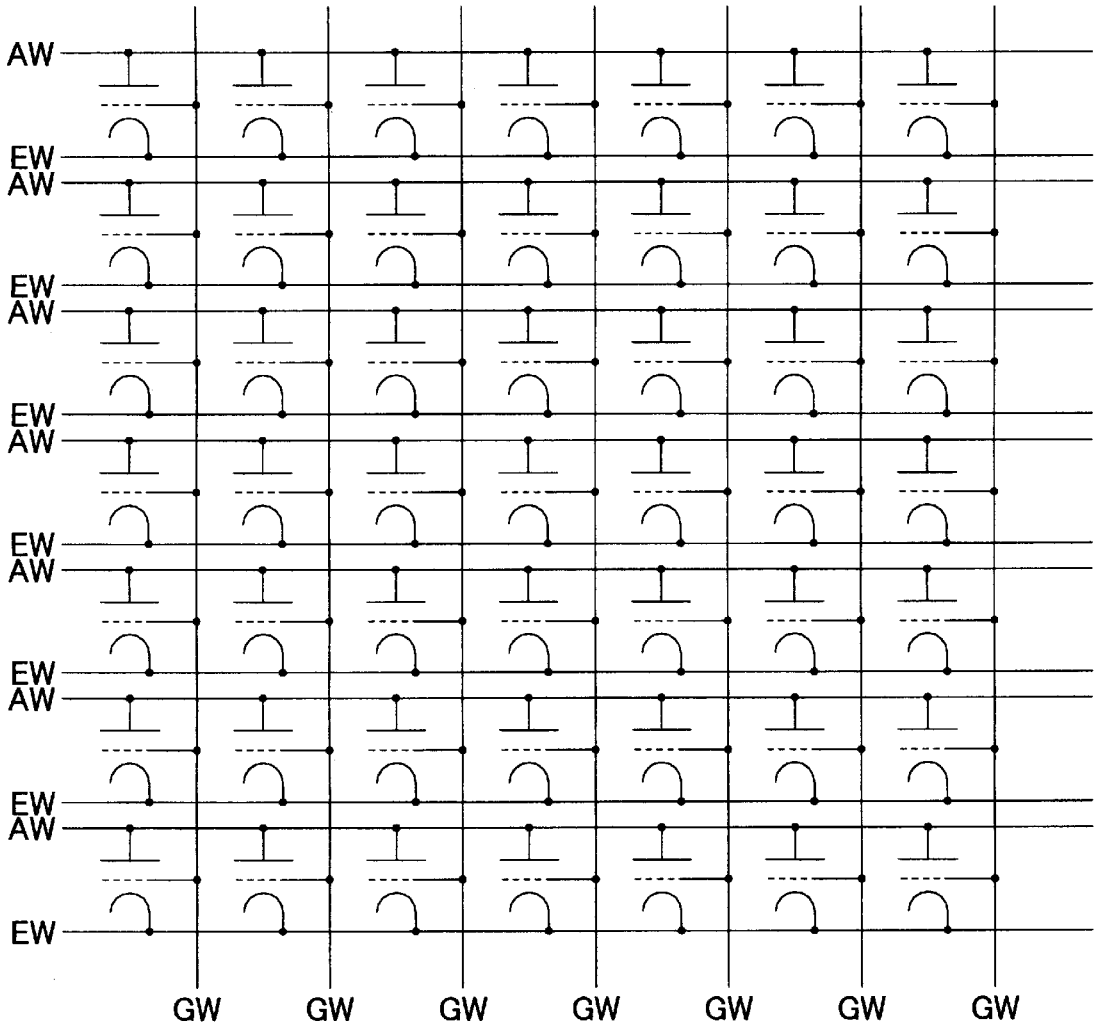
FIG. 18 is a circuit diagram of a flat panel display.

FIG. 18 is an equivalent circuit diagram of a flat panel display which is made of a field emitter array (FEA) having a number of two- or three-electrode elements.

A number of three-electrode elements (triodes) are disposed at cross points between two-dimensionally patterned emitter wirings EW and gate wirings GW. The anode wiring AW of an anode electrode (transparent substrate) 67 of each triode is always maintained at a positive potential. The triodes are two-dimensionally disposed by the emitter wirings EW and gate wirings GW, and the triode at the cross point of the voltage-applied emitter wiring EW and gate wiring SW is selected.

The emitter electrode and gate electrode of the selected triode are applied with negative and positive potentials, respectively, so that electrons are emitted from the emitter electrode to the anode electrode.

In the first and second embodiments of the field emission element, the side spacer is formed by etching, and is further etched to etch the upper portion of the side spacer.

With this process, an emitter having the two-stage shaped structure can be formed. The radius of curvature of the first stage structure of an emitter of the two-stage shaped structure can be set to a desired value independently from that of the second stage structure. It is therefore possible to form an emitter having a small apex angle and radius of curvature.

The relative position can be easily regulated by adjusting the etch-back amount of the side spacer and/or the thickness of the film deposited on the side spacer.

The present invention has been described in connection with the preferred embodiments. The invention is not limited only to the above embodiments. It is apparent that various modifications, improvements, combinations, and the like can be made by those skilled in the art.

I claim:

1. A method of manufacturing a field emission device, comprising the steps of:

(a) providing a substrate;

(b) forming a conductive film over the substrate, the conductive film having a vertical cross section which includes laterally separated regions;

(c) forming a first sacrificial Layer over the conductive film and the substrate;

(d) removing the first sacrificial layer so as to leave a spacer film on a side wall of the conductive film, the spacer film having a height lower than the conductive film and a part of the substrate being etched to provide a recess having a rounded corner at a bottom of the recess;

(e) forming a second sacrificial layer over the conductive film, the spacer film and the substrate; and (f) forming an electron emitting material layer over the second sacrificial layer.

2. A method according to claim 1, wherein the substrate includes an insulating layer thereon, and the recess is provided in the insulating layer.

3. A method according to claim 1, wherein a thickness of the first sacrificial layer is larger than a value of a radius of curvature of the rounded corner.

4. A method according to claim 1, wherein the first sacrificial layer is made of a material selected from a group consisting of $SiO_2$, $SiN_x$, polysilicon, amorphous silicon, $WSi_x$, $MoSi_x$, $TaSi_x$, Al, Cu and W.

5. A method according to claim 1, wherein the conductive film is made of a material selected from a group consisting of polysilicon, amorphous silicon, $WSi_x$, $MoSi_x$, $TaSi_x$, Al, Cu and W.

6. A method according to claim 1, wherein the electron emitting material layer is made of a material selected from a group consisting of TiN, Mo, Cr, Ti and W.

7. A method according to claim 1, further comprising the step of:

(g) removing the substrate, the conductive film, the spacer film and the second sacrificial layer so as to expose the electron emitting material layer.

8. A method according to claim 7, further comprising the step of:

(h) forming a support structure on a back of the electron emitting material layer.

9. A method according to claim 1, wherein the electron emitting material layer has taper portions of which diameters gradually change.

10. A method of manufacturing a field emission device, comprising the steps of:

(a) providing a substrate;

(b) forming a conductive layer having a hole therein on the substrate;

(c) forming a first sacrificial layer over the conductive layer and the substrate;

(d) removing the first sacrificial layer so as to leave a spacer film on a side wall of the conductive layer, the spacer film creating a step against an upper surface of the conductive layer and a part of the substrate being etched to provide a recess having a rounded corner at a bottom of the recess;

(e) forming a second sacrificial layer over the conductive layer, the spacer film and the substrate, the second sacrificial layer having a shape which reflects topography of the recess, the conductive layer, the spacer film, and the step therebetween to provide a mold; and (f) forming an electron emitting material layer over the second sacrificial layer to provide an emitter having a shape transferring the mold.

11. A method according to claim 10, wherein the substrate includes an insulating layer thereon, and the recess is provided in the insulating layer.

12. A method according to claim 10, wherein a thickness of the first sacrificial layer is larger than a value of a radius of curvature of the rounded corner.

13. A method according to claim 10, wherein the first sacrificial layer is made of a material selected from a group consisting of $SiO_2$, $SiN_x$, polysilicon, amorphous silicon, $WSi_x$, $MoSi_x$, $TaSi_x$, Al, Cu and W.

14. A method according to claim 10, wherein the conductive layer is made of a material selected from a group consisting of polysilicon, amorphous silicon, $WSi_x$, $MoSi_x$, $TaSi_x$, Al, Cu and W.

15. A method according to claim 10, wherein the electron emitting material layer is made of a material selected from a group consisting of TiN, Mo, Cr, Ti and W.

16. A method according to claim 10, wherein the electron emitting material layer has taper portions of which diameters gradually change.

17. A method of manufacturing a field emission element comprising the steps of:

(a) forming a first film on an underlying substrate;

(b) forming a second film on the first film;

(c) forming an opening in a partial region of the second film, the opening reaching the first film;

(d) forming a first sacrificial film on the bottom of the opening and on the second film;

(e) etching back the first sacrificial film and leaving a side spacer on the side wall of the opening, the side spacer being made of the first sacrificial film;

(f) continuing to etch back the first sacrificial film to form a recess in the underlying substrate by forming an opening reaching the underlying substrate in the first film, by using the side spacer and the second film as a mask;

(g) depositing a second sacrificial film on the recess, the side spacer and the second film to form a cusp on the surface of the second sacrificial film, the cusp having a sharp apex at a deepest point where side walls of the second sacrificial film as viewed in cross section contact at the first time; and (h) forming a field emission cathode electrode having a sharp apex by depositing a conductive film on the second sacrificial film and filling the cusp.

18. A method according to claim 17, wherein said step (g) deposits the second sacrificial film to a thickness larger than a radius of curvature of a rounded corner formed at the bottom of the recess.

19. A method according to claim 17, wherein said step (f) includes a step of etching the side spacer to expose the first firm at an upper portion of a side wall of the recess and leave the side spacer at a lower portion of the side wall of the recess.

20. A method according to claim 17, wherein said step (f) etches at an etching rate of the side space and the underlying substrate faster than an etching rate of the second film.

21. A method according to claim 17, wherein the underlying substrate includes an insulating film formed on the surface of a semiconductor substrate or a conductive substrate.

22. A method according to claim 17, further comprising the step of:

(i) exposing the tip of the field emission cathode after said step (h).

23. A method according to claim 17, wherein the first film is a gate electrode made of semiconductor or conductive material, the field emission cathode is an emitter electrode, the method further comprises the step of (i) exposing the tip of the emitter electrode and the end of the gate electrode after said step (h), and the field emission element has a two-electrode structure.

24. A method according to claim 23, further comprising the step of:

(j) fixing the field emission cathode to a support substrate.

25. A method according to claim 17, further comprising the step of:

(i) fixing the field emission cathode to a support substrate.

26. A method according to claim 17, wherein the first film is a gate electrode made of semiconductor or conductive material, the field emission cathode is an emitter electrode, the underlying substrate is an anode electrode made of a semiconductor substrate or a conductive substrate formed with an insulating film on the surface thereof, the method further comprises the step of (i) exposing the tip of the emitter electrode and the end of the gate electrode and the anode electrode after said step (h), and the field emission element has a three-electrode structure.

* * * * *